US011988049B2

(12) United States Patent
Eitschberger et al.

(10) Patent No.: US 11,988,049 B2
(45) **Date of Patent: *May 21, 2024**

(54) ALIGNMENT SUB AND PERFORATING GUN ASSEMBLY WITH ALIGNMENT SUB

(71) Applicant: DynaEnergetics Europe GmbH, Troisdorf (DE)

(72) Inventors: Christian Eitschberger, Munich (DE); Eric Mulhern, Edmonton (CA)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/955,815

(22) Filed: Sep. 29, 2022

(65) Prior Publication Data

US 2023/0016759 A1 Jan. 19, 2023

Related U.S. Application Data

(63) Continuation of application No. PCT/EP2021/058182, filed on Mar. 29, 2021, which is a continuation of application No. 17/206,416, filed on Mar. 19, 2021, now Pat. No. 11,339,614.

(60) Provisional application No. 63/002,507, filed on Mar. 31, 2020.

(51) Int. Cl.

| | |
|---|---|
| ***E21B 17/043*** | (2006.01) |
| ***E21B 17/02*** | (2006.01) |
| ***E21B 17/042*** | (2006.01) |
| ***E21B 43/119*** | (2006.01) |

(52) U.S. Cl.
CPC ..... *E21B 17/043* (2013.01); *E21B 17/028* (2013.01); *E21B 17/0423* (2013.01); *E21B 43/119* (2013.01)

(58) Field of Classification Search
CPC .. E21B 17/043; E21B 17/028; E21B 17/0423; E21B 43/119
See application file for complete search history.

(56) References Cited

U.S. PATENT DOCUMENTS

| | | | |
|---|---|---|---|
| 2,147,544 | A | 2/1939 | Potts |
| 2,216,359 | A | 10/1940 | Spencer |
| 2,228,873 | A | 1/1941 | Hardt et al. |

(Continued)

FOREIGN PATENT DOCUMENTS

| | | |
|---|---|---|
| CA | 2003166 A1 | 5/1991 |
| CA | 2821506 A1 | 1/2015 |

(Continued)

OTHER PUBLICATIONS

Schlumberger & Said Abubakr, Combining and Customizing Technologies for Perforating Horizontal Wells in Algeria, Presented at 2011 MENAPS, Nov. 28-30, 2011, 20 pages.

(Continued)

*Primary Examiner* — D. Andrews
(74) *Attorney, Agent, or Firm* — Womble Bond Dickinson (US) LLP

(57) ABSTRACT

A perforating gun assembly may include a first perforating gun housing, a first shaped charge provided within the first perforating gun housing, and an alignment sub coupled to the first perforating gun housing. The alignment sub may include a first sub body and a second sub body rotatably coupled to the first sub body.

19 Claims, 16 Drawing Sheets

(56) References Cited

U.S. PATENT DOCUMENTS 2,296,346 A 9/1942 Hearn
2,326,406 A 8/1943 Lloyd
2,358,466 A 9/1944 Miller
2,418,486 A 4/1947 Smylie
2,439,394 A 4/1948 Lanzalotti et al.
2,519,116 A 8/1950 Crake
2,543,814 A 3/1951 Thompson et al.
2,598,651 A 5/1952 Spencer
2,621,744 A 12/1952 Toelke
2,655,993 A 10/1953 Lloyd
2,696,258 A 12/1954 Greene
2,734,456 A 2/1956 Sweetman
2,755,863 A 7/1956 Stansbury et al.
2,785,631 A 3/1957 Blanchard
2,889,775 A 6/1959 Owen
2,906,339 A 9/1959 Griffin
2,946,283 A 7/1960 Udry
2,982,210 A 5/1961 Andrew et al.
3,040,659 A 6/1962 Mcculleugh
RE25,407 E 6/1963 Lebourg
3,125,024 A 3/1964 Hicks et al.
3,155,164 A 11/1964 Keener
3,158,680 A 11/1964 Lovitt et al.
3,170,400 A 2/1965 Nelson
3,173,992 A 3/1965 Boop
RE25,846 E 8/1965 Campbell
3,246,707 A 4/1966 Bell
3,264,989 A 8/1966 Rucker
3,264,994 A 8/1966 Kurt
3,336,054 A 8/1967 Blount et al.
3,374,735 A 3/1968 Moore
3,426,849 A 2/1969 Brumble, Jr.
3,426,850 A 2/1969 Mcduffie, Jr.
3,504,723 A 4/1970 Cushman et al.
3,565,188 A 2/1971 Hakala
3,859,921 A 1/1975 Stephenson
3,923,105 A * 12/1975 Lands, Jr. ..... E21B 43/1185 175/4.55
4,007,790 A 2/1977 Henning
4,007,796 A 2/1977 Boop
4,039,239 A 8/1977 Cobaugh et al.
4,058,061 A 11/1977 Mansur, Jr. et al.
4,100,978 A 7/1978 Boop
4,107,453 A 8/1978 Erixon
4,132,171 A 1/1979 Pawlak et al.
4,140,188 A 2/1979 Vann
4,172,421 A 10/1979 Regalbuto
4,182,216 A 1/1980 DeCaro
4,191,265 A 3/1980 Bosse-Platiere
4,208,966 A 6/1980 Hart
4,220,087 A 9/1980 Posson
4,266,613 A 5/1981 Boop
4,290,486 A 9/1981 Regalbuto
4,312,273 A 1/1982 Camp
4,363,529 A 12/1982 Loose
4,411,491 A 10/1983 Larkin et al.
4,457,383 A 7/1984 Boop
4,485,741 A 12/1984 Moore et al.
4,491,185 A 1/1985 McClure
4,496,008 A 1/1985 Pottier et al.
4,512,418 A 4/1985 Regalbuto et al.
4,523,649 A 6/1985 Stout
4,523,650 A 6/1985 Sehnert et al.
4,534,423 A 8/1985 Regalbuto
4,574,892 A 3/1986 Grigar et al.
4,598,775 A 7/1986 Vann et al.
4,609,057 A 9/1986 Walker et al.
4,621,396 A 11/1986 Walker et al.
4,629,001 A 12/1986 Miller et al.
4,643,097 A 2/1987 Chawla et al.
4,650,009 A 3/1987 McClure et al.
4,657,089 A 4/1987 Stout
4,660,910 A 4/1987 Sharp et al.
4,730,793 A 3/1988 Thurber, Jr. et al.
4,744,424 A 5/1988 Lendermon et al.
4,747,201 A 5/1988 Donovan et al.
4,753,170 A 6/1988 Regalbuto et al.
4,762,067 A 8/1988 Barker et al.
4,776,393 A 10/1988 Forehand et al.
4,790,383 A 12/1988 Savage et al.
4,796,708 A 1/1989 Lembcke
4,800,815 A 1/1989 Appledorn et al.
4,852,494 A 8/1989 Williams
4,869,171 A 9/1989 Abouav
4,889,183 A 12/1989 Sommers et al.
5,006,833 A 4/1991 Marlowe et al.
5,027,708 A 7/1991 Gonzalez et al.
5,033,553 A 7/1991 Miszewski et al.
5,038,682 A 8/1991 Marsden
5,050,691 A 9/1991 Moses
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,204,491 A 4/1993 Aureal et al.
5,237,136 A 8/1993 Langston
5,241,891 A 9/1993 Hayes et al.
5,322,019 A 6/1994 Hyland
5,334,801 A 8/1994 Mohn
5,347,929 A 9/1994 Lerche et al.
5,358,418 A 10/1994 Carmichael
5,392,851 A 2/1995 Arend
5,392,860 A 2/1995 Ross
5,436,791 A 7/1995 Turano et al.
5,490,563 A 2/1996 Wesson et al.
5,503,077 A 4/1996 Motley
5,531,164 A 7/1996 Mosley
5,603,384 A 2/1997 Bethel et al.
5,648,635 A 7/1997 Lussier et al.
5,671,899 A 9/1997 Nicholas et al.
5,703,319 A 12/1997 Fritz et al.
5,756,926 A 5/1998 Bonbrake et al.
5,775,426 A 7/1998 Snider et al.
5,778,979 A 7/1998 Burleson et al.
5,785,130 A 7/1998 Wesson et al.
5,791,914 A 8/1998 Loranger et al.
5,803,175 A 9/1998 Myers, Jr. et al.
5,816,343 A 10/1998 Markel et al.
5,820,402 A 10/1998 Chiacchio et al.
5,823,266 A 10/1998 Burleson et al.
5,837,925 A 11/1998 Nice
5,911,277 A 6/1999 Hromas et al.
5,964,294 A 10/1999 Edwards et al.
5,992,289 A 11/1999 George et al.
6,006,833 A 12/1999 Burleson et al.
6,012,525 A 1/2000 Burleson et al.
6,056,058 A 5/2000 Gonzalez
6,062,310 A 5/2000 Wesson et al.
6,070,662 A 6/2000 Ciglenec et al.
6,112,666 A 9/2000 Murray et al.
6,196,325 B1 3/2001 Connell et al.
6,263,283 B1 7/2001 Snider et al.
6,269,875 B1 8/2001 Harrison, III et al.
6,297,447 B1 10/2001 Burnett et al.
6,298,915 B1 10/2001 George
6,305,287 B1 10/2001 Capers et al.
6,315,461 B1 11/2001 Cairns
6,333,699 B1 12/2001 Zierolf
6,354,374 B1 3/2002 Edwards et al.
6,385,031 B1 5/2002 Lerche et al.
6,386,108 B1 5/2002 Brooks et al.
6,408,758 B1 6/2002 Duguet
6,412,388 B1 7/2002 Frazier
6,412,415 B1 7/2002 Kothari et al.
6,418,853 B1 7/2002 Duguet et al.
6,419,044 B1 7/2002 Tite et al.
6,439,121 B1 8/2002 Gillingham
6,464,511 B1 10/2002 Watanabe et al.
6,467,415 B2 10/2002 Menzel et al.
6,474,931 B1 11/2002 Austin et al.
6,487,973 B1 12/2002 Gilbert, Jr. et al.
6,497,285 B2 12/2002 Walker

(56) References Cited

U.S. PATENT DOCUMENTS

| | | | |
|---|---|---|---|
| 6,506,083 | B1 | 1/2003 | Bickford et al. |
| 6,516,901 | B1 | 2/2003 | Falgout |
| 6,582,251 | B1 | 6/2003 | Burke et al. |
| 6,595,290 | B2 | 7/2003 | George et al. |
| 6,618,237 | B2 | 9/2003 | Eddy et al. |
| 6,651,747 | B2 | 11/2003 | Chen et al. |
| 6,659,180 | B2 | 12/2003 | Moss |
| 6,675,896 | B2 | 1/2004 | George |
| 6,719,061 | B2 | 4/2004 | Muller et al. |
| 6,739,265 | B1 | 5/2004 | Badger et al. |
| 6,742,602 | B2 | 6/2004 | Trotechaud |
| 6,752,083 | B1 | 6/2004 | Lerche et al. |
| 6,773,312 | B2 | 8/2004 | Bauer et al. |
| 6,776,668 | B1 | 8/2004 | Scyoc et al. |
| 6,779,605 | B2 | 8/2004 | Jackson |
| 6,822,542 | B2 | 11/2004 | Clark et al. |
| 6,837,310 | B2 | 1/2005 | Martin |
| 6,843,317 | B2 | 1/2005 | Mackenzie |
| 6,851,471 | B2 | 2/2005 | Barlow et al. |
| 6,851,476 | B2 | 2/2005 | Gray et al. |
| 6,902,414 | B2 | 6/2005 | Dopf et al. |
| 7,013,977 | B2 | 3/2006 | Nordaas |
| 7,044,230 | B2 | 5/2006 | Starr et al. |
| 7,074,064 | B2 | 7/2006 | Wallace |
| 7,093,664 | B2 | 8/2006 | Todd et al. |
| 7,107,908 | B2 | 9/2006 | Forman et al. |
| 7,114,564 | B2 | 10/2006 | Parrott et al. |
| 7,147,068 | B2 | 12/2006 | Vail, III |
| 7,168,494 | B2 | 1/2007 | Starr et al. |
| 7,182,625 | B2 | 2/2007 | Machado et al. |
| 7,193,156 | B2 | 3/2007 | Alznauer et al. |
| 7,193,527 | B2 | 3/2007 | Hall |
| 7,210,524 | B2 | 5/2007 | Sloan et al. |
| 7,237,626 | B2 | 7/2007 | Gurjar et al. |
| 7,243,722 | B2 | 7/2007 | Oosterling et al. |
| 7,278,491 | B2 | 10/2007 | Scott |
| 7,297,004 | B1 | 11/2007 | Shuhart et al. |
| 7,306,038 | B2 | 12/2007 | Challacombe |
| 7,347,278 | B2 | 3/2008 | Lerche et al. |
| 7,347,279 | B2 | 3/2008 | Li et al. |
| 7,350,448 | B2 | 4/2008 | Bell et al. |
| 7,353,879 | B2 | 4/2008 | Todd et al. |
| 7,357,083 | B2 | 4/2008 | Takahara et al. |
| 7,360,487 | B2 | 4/2008 | Myers, Jr. et al. |
| 7,364,451 | B2 | 4/2008 | Ring et al. |
| 7,387,162 | B2 | 6/2008 | Mooney, Jr. et al. |
| 7,404,725 | B2 | 7/2008 | Hall et al. |
| 7,441,601 | B2 | 10/2008 | George et al. |
| 7,473,104 | B1 | 1/2009 | Wertz |
| 7,476,132 | B2 | 1/2009 | Xu |
| 7,493,945 | B2 | 2/2009 | Doane et al. |
| 7,493,961 | B2 | 2/2009 | Scott |
| 7,510,017 | B2 | 3/2009 | Howell et al. |
| 7,540,758 | B2 | 6/2009 | Ho |
| 7,544,102 | B2 | 6/2009 | Oda |
| 7,565,927 | B2 | 7/2009 | Gerez et al. |
| 7,568,429 | B2 | 8/2009 | Hummel et al. |
| 7,591,212 | B2 | 9/2009 | Myers, Jr. et al. |
| 7,690,925 | B2 | 4/2010 | Goodman |
| 7,726,396 | B2 | 6/2010 | Briquet et al. |
| 7,735,578 | B2 | 6/2010 | Loehr et al. |
| 7,752,971 | B2 | 7/2010 | Loehr |
| 7,762,172 | B2 | 7/2010 | Li et al. |
| 7,762,331 | B2 | 7/2010 | Goodman et al. |
| 7,762,351 | B2 | 7/2010 | Vidal |
| 7,775,279 | B2 | 8/2010 | Marya et al. |
| 7,778,006 | B2 | 8/2010 | Stewart et al. |
| 7,789,153 | B2 | 9/2010 | Prinz et al. |
| 7,810,430 | B2 | 10/2010 | Chan et al. |
| 7,815,440 | B2 | 10/2010 | Hsieh et al. |
| 7,901,247 | B2 | 3/2011 | Ring |
| 7,908,970 | B1 | 3/2011 | Jakaboski et al. |
| 7,929,270 | B2 | 4/2011 | Hummel et al. |
| 7,934,453 | B2 | 5/2011 | Moore |
| 7,980,874 | B2 | 7/2011 | Finke et al. |
| 8,028,624 | B2 | 10/2011 | Mattson |
| 8,061,425 | B2 | 11/2011 | Hales et al. |
| 8,066,083 | B2 | 11/2011 | Hales et al. |
| 8,069,789 | B2 | 12/2011 | Hummel et al. |
| 8,074,713 | B2 | 12/2011 | Ramos et al. |
| 8,074,737 | B2 | 12/2011 | Hill et al. |
| 8,079,296 | B2 | 12/2011 | Barton et al. |
| 8,091,477 | B2 | 1/2012 | Brooks et al. |
| 8,127,846 | B2 | 3/2012 | Hill et al. |
| 8,136,439 | B2 | 3/2012 | Bell |
| 8,141,434 | B2 | 3/2012 | Kippersund et al. |
| 8,151,882 | B2 | 4/2012 | Grigar et al. |
| 8,157,022 | B2 | 4/2012 | Bertoja et al. |
| 8,181,718 | B2 | 5/2012 | Burleson et al. |
| 8,182,212 | B2 | 5/2012 | Parcell |
| 8,186,259 | B2 | 5/2012 | Burleson et al. |
| 8,230,788 | B2 | 7/2012 | Brooks et al. |
| 8,256,337 | B2 | 9/2012 | Hill et al. |
| 8,336,437 | B2 | 12/2012 | Barlow et al. |
| 8,387,533 | B2 | 3/2013 | Runkel |
| 8,388,374 | B2 | 3/2013 | Grek et al. |
| 8,395,878 | B2 | 3/2013 | Stewart et al. |
| 8,413,727 | B2 | 4/2013 | Holmes |
| D682,384 | S | 5/2013 | Jaureguizar |
| 8,439,114 | B2 | 5/2013 | Parrott et al. |
| 8,451,137 | B2 | 5/2013 | Bonavides et al. |
| 8,468,944 | B2 | 6/2013 | Givens et al. |
| 8,596,378 | B2 | 12/2013 | Mason et al. |
| D698,904 | S | 2/2014 | Milligan et al. |
| 8,661,978 | B2 | 3/2014 | Backhus et al. |
| 8,678,666 | B2 | 3/2014 | Scadden et al. |
| 8,684,083 | B2 | 4/2014 | Torres et al. |
| 8,695,506 | B2 | 4/2014 | Lanclos |
| 8,807,003 | B2 | 8/2014 | Le et al. |
| 8,833,441 | B2 | 9/2014 | Fielder et al. |
| 8,863,665 | B2 | 10/2014 | DeVries et al. |
| 8,869,887 | B2 | 10/2014 | Deere et al. |
| 8,875,787 | B2 | 11/2014 | Tassaroli |
| 8,875,796 | B2 | 11/2014 | Hales et al. |
| 8,881,816 | B2 | 11/2014 | Glenn et al. |
| 8,884,778 | B2 | 11/2014 | Lerche et al. |
| 8,943,943 | B2 | 2/2015 | Tassaroli |
| 8,960,093 | B2 | 2/2015 | Preiss et al. |
| 8,960,288 | B2 | 2/2015 | Sampson |
| 9,065,201 | B2 | 6/2015 | Borgfeld et al. |
| 9,080,433 | B2 | 7/2015 | Lanclos et al. |
| 9,145,763 | B1 | 9/2015 | Sites, Jr. |
| 9,145,764 | B2 | 9/2015 | Burton et al. |
| 9,157,718 | B2 * | 10/2015 | Ross ..... E21B 43/1185 |
| 9,181,790 | B2 | 11/2015 | Mace et al. |
| 9,194,219 | B1 | 11/2015 | Hardesty et al. |
| 9,206,675 | B2 | 12/2015 | Hales et al. |
| 9,284,819 | B2 | 3/2016 | Tolman et al. |
| 9,284,824 | B2 | 3/2016 | Fadul et al. |
| 9,297,242 | B2 | 3/2016 | Zhang et al. |
| 9,317,038 | B2 | 4/2016 | Ozick et al. |
| 9,347,755 | B2 | 5/2016 | Backhus et al. |
| 9,359,863 | B2 | 6/2016 | Streich et al. |
| 9,383,237 | B2 | 7/2016 | Wiklund et al. |
| 9,441,438 | B2 | 9/2016 | Allison et al. |
| 9,466,916 | B2 | 10/2016 | Li et al. |
| 9,476,289 | B2 | 10/2016 | Wells |
| 9,484,646 | B2 | 11/2016 | Thomas |
| 9,494,021 | B2 | 11/2016 | Parks et al. |
| 9,523,265 | B2 | 12/2016 | Upchurch et al. |
| 9,523,271 | B2 | 12/2016 | Bonavides et al. |
| 9,581,422 | B2 | 2/2017 | Preiss et al. |
| 9,593,548 | B2 | 3/2017 | Hill et al. |
| 9,598,942 | B2 | 3/2017 | Wells et al. |
| 9,605,937 | B2 | 3/2017 | Eitschberger et al. |
| D783,133 | S | 4/2017 | Fitzhugh et al. |
| 9,617,814 | B2 | 4/2017 | Seals et al. |
| 9,634,427 | B2 | 4/2017 | Lerner et al. |
| 9,677,363 | B2 | 6/2017 | Schacherer et al. |
| 9,689,223 | B2 | 6/2017 | Schacherer et al. |
| 9,702,211 | B2 | 7/2017 | Tinnen |
| 9,702,680 | B2 | 7/2017 | Parks et al. |
| 9,709,373 | B2 | 7/2017 | Hikone et al. |
| 9,784,549 | B2 | 10/2017 | Eitschberger |

(56) References Cited

U.S. PATENT DOCUMENTS

D807,991 S 1/2018 Fitzhugh et al.
9,903,192 B2 2/2018 Entchev et al.
10,060,234 B2 8/2018 Robey et al.
10,066,921 B2 9/2018 Eitschberger
10,077,641 B2 9/2018 Rogman et al.
10,125,561 B2 11/2018 Cramm et al.
10,138,713 B2 11/2018 Tolman et al.
10,151,180 B2 12/2018 Robey et al.
10,188,990 B2 1/2019 Burmeister et al.
10,190,398 B2 1/2019 Goodman et al.
10,352,144 B2 7/2019 Entchev et al.
10,385,629 B2 8/2019 Spence et al.
10,400,558 B1 9/2019 Shahinpour et al.
10,435,960 B2 10/2019 Stokes
10,458,213 B1 10/2019 Eitschberger et al.
10,472,938 B2 11/2019 Parks et al.
10,683,703 B2 6/2020 Faircloth et al.
11,008,817 B2 5/2021 Stokes et al.
11,078,762 B2 8/2021 Mauldin et al.
11,339,614 B2 * 5/2022 Mulhern ..... E21B 17/028
11,492,854 B2 11/2022 Langford et al.
11,555,385 B2 * 1/2023 Ursi ..... E21B 43/119
2002/0020320 A1 2/2002 Lebaudy et al.
2002/0062991 A1 5/2002 Farrant et al.
2002/0185275 A1 12/2002 Yang et al.
2003/0000411 A1 1/2003 Cernocky et al.
2003/0001753 A1 1/2003 Cernocky et al.
2003/0098158 A1 5/2003 George et al.
2004/0141279 A1 7/2004 Amano et al.
2004/0211862 A1 10/2004 Elam
2005/0139352 A1 6/2005 Mauldin
2005/0167101 A1 8/2005 Sugiyama
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0218260 A1 10/2005 Corder et al.
2005/0229805 A1 10/2005 Myers, Jr. et al.
2005/0230099 A1 10/2005 Thomson et al.
2005/0257710 A1 11/2005 Monetti et al.
2005/0279513 A1 12/2005 Eppink
2006/0075889 A1 4/2006 Walker
2007/0084336 A1 4/2007 Neves
2007/0125540 A1 6/2007 Gerez et al.
2007/0158071 A1 7/2007 Mooney, Jr. et al.
2008/0029302 A1 2/2008 Scott
2008/0047456 A1 2/2008 Li et al.
2008/0047716 A1 2/2008 McKee et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0173240 A1 7/2008 Furukawahara et al.
2008/0264639 A1 10/2008 Parrott et al.
2009/0050322 A1 2/2009 Hill et al.
2009/0151588 A1 6/2009 Burleson et al.
2009/0159285 A1 6/2009 Goodman
2009/0272519 A1 11/2009 Green et al.
2009/0272529 A1 11/2009 Crawford
2009/0301723 A1 12/2009 Gray
2009/0308589 A1 12/2009 Bruins et al.
2010/0000789 A1 1/2010 Barton et al.
2010/0012774 A1 1/2010 Fanucci et al.
2010/0022125 A1 1/2010 Burris et al.
2010/0024674 A1 2/2010 Peeters et al.
2010/0089643 A1 4/2010 Vidal
2010/0096131 A1 4/2010 Hill et al.
2010/0107917 A1 5/2010 Moser
2010/0163224 A1 7/2010 Strickland
2010/0206064 A1 8/2010 Estes
2010/0230104 A1 9/2010 Nölke et al.
2010/0230163 A1 9/2010 Hales et al.
2010/0286800 A1 11/2010 Lerche et al.
2010/0300750 A1 12/2010 Hales et al.
2011/0024116 A1 2/2011 McCann et al.
2011/0042069 A1 2/2011 Bailey et al.
2011/0100627 A1 5/2011 Hales et al.
2011/0301784 A1 12/2011 Oakley et al.
2012/0006217 A1 1/2012 Anderson
2012/0080202 A1 4/2012 Greenlee et al.
2012/0085538 A1 4/2012 Guerrero et al.
2012/0094553 A1 4/2012 Fujiwara et al.
2012/0160483 A1 6/2012 Carisella
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli et al.
2013/0008669 A1 1/2013 Deere et al.
2013/0037255 A1 2/2013 Kash et al.
2013/0043074 A1 2/2013 Tassaroli
2013/0048375 A1 2/2013 Rodgers et al.
2013/0062055 A1 3/2013 Tolman et al.
2013/0112396 A1 5/2013 Splittstoeßer
2013/0118342 A1 5/2013 Tassaroli
2013/0168083 A1 7/2013 McCarter et al.
2013/0199843 A1 8/2013 Ross
2013/0220614 A1 8/2013 Torres et al.
2013/0248174 A1 9/2013 Dale et al.
2013/0256464 A1 10/2013 Belik et al.
2014/0000877 A1 1/2014 Robertson et al.
2014/0033939 A1 2/2014 Priess et al.
2014/0053750 A1 2/2014 Lownds et al.
2014/0127941 A1 5/2014 Lu
2014/0131035 A1 5/2014 Entchev et al.
2014/0148044 A1 5/2014 Balcer et al.
2015/0075783 A1 3/2015 Angman et al.
2015/0176386 A1 6/2015 Castillo et al.
2015/0226044 A1 8/2015 Ursi et al.
2015/0308208 A1 10/2015 Capps et al.
2015/0330192 A1 11/2015 Rogman et al.
2015/0345922 A1 12/2015 Lanclos et al.
2016/0040520 A1 2/2016 Tolman et al.
2016/0061572 A1 3/2016 Eitschberger et al.
2016/0069163 A1 3/2016 Tolman et al.
2016/0084048 A1 3/2016 Harrigan et al.
2016/0168961 A1 6/2016 Parks et al.
2016/0178333 A1 6/2016 Biggs et al.
2016/0208587 A1 7/2016 Hardesty et al.
2016/0273902 A1 9/2016 Eitschberger
2016/0290084 A1 10/2016 LaGrange et al.
2016/0333675 A1 11/2016 Wells et al.
2016/0356132 A1 12/2016 Burmeister et al.
2016/0365667 A1 12/2016 Mueller et al.
2017/0030693 A1 2/2017 Preiss et al.
2017/0052011 A1 2/2017 Parks et al.
2017/0145798 A1 5/2017 Robey et al.
2017/0211363 A1 7/2017 Bradley et al.
2017/0241244 A1 8/2017 Barker et al.
2017/0268317 A1 9/2017 Kaenel et al.
2017/0268860 A1 9/2017 Eitschberger
2017/0314372 A1 11/2017 Tolman et al.
2018/0030334 A1 2/2018 Collier et al.
2018/0087330 A1 3/2018 Bradley et al.
2018/0119529 A1 5/2018 Goyeneche
2018/0135398 A1 5/2018 Entchev et al.
2018/0202789 A1 7/2018 Parks et al.
2018/0209251 A1 7/2018 Robey et al.
2018/0252054 A1 9/2018 Stokes
2018/0274342 A1 9/2018 Sites
2018/0299239 A1 10/2018 Eitschberger et al.
2018/0318770 A1 11/2018 Eitschberger et al.
2018/0347324 A1 12/2018 Langford et al.
2019/0032470 A1 1/2019 Harrigan
2019/0040722 A1 2/2019 Yang et al.
2019/0048693 A1 2/2019 Henke et al.
2019/0049225 A1 2/2019 Eitschberger
2019/0153827 A1 5/2019 Goyeneche
2019/0162056 A1 5/2019 Sansing
2019/0186241 A1 6/2019 Yang et al.
2019/0195054 A1 6/2019 Bradley et al.

(56) References Cited

U.S. PATENT DOCUMENTS

| | | | |
|---|---|---|---|
| 2019/0211655 | A1 | 7/2019 | Bradley et al. |
| 2019/0234188 | A1 | 8/2019 | Goyeneche |
| 2019/0257158 | A1 | 8/2019 | Langford et al. |
| 2019/0284889 | A1 | 9/2019 | LaGrange et al. |
| 2019/0292887 | A1 | 9/2019 | Austin et al. |
| 2019/0316449 | A1 | 10/2019 | Schultz et al. |
| 2019/0330947 | A1 | 10/2019 | Mulhern et al. |
| 2020/0063553 | A1 | 2/2020 | Zemla et al. |
| 2020/0088011 | A1 | 3/2020 | Eitschberger et al. |
| 2020/0182025 | A1 | 6/2020 | Brady |
| 2020/0217635 | A1 | 7/2020 | Eitschberger |
| 2020/0248536 | A1 | 8/2020 | Holodnak et al. |
| 2020/0256166 | A1 | 8/2020 | Knight et al. |
| 2020/0256168 | A1 | 8/2020 | Knight et al. |
| 2020/0284104 | A1 | 9/2020 | Holmberg et al. |
| 2020/0362652 | A1 | 11/2020 | Eitschberger et al. |
| 2020/0362654 | A1 | 11/2020 | Eitschberger et al. |
| 2020/0378731 | A1 | 12/2020 | Mcnelis |
| 2020/0399995 | A1 | 12/2020 | Preiss et al. |
| 2021/0277753 | A1 | 9/2021 | Ursi et al. |

FOREIGN PATENT DOCUMENTS

| | | | |
|---|---|---|---|
| CA | 2824838 | A1 | 2/2015 |
| CA | 2888787 | A1 | 10/2015 |
| CA | 2980935 | A1 | 10/2016 |
| CN | 85107897 | A | 9/1986 |
| CN | 2661919 | | 12/2004 |
| CN | 2821154 | | 9/2006 |
| CN | 101397890 | A | 4/2009 |
| CN | 101691837 | B | 4/2010 |
| CN | 101892822 | B | 11/2010 |
| CN | 201620848 | U | 11/2010 |
| CN | 201764910 | U | 3/2011 |
| CN | 102878877 | A | 1/2013 |
| CN | 103993861 | A | 8/2014 |
| CN | 104278976 | A | 1/2015 |
| CN | 104989335 | A | 10/2015 |
| DE | 102007007498 | | 10/2015 |
| EP | 0088516 | A1 | 9/1983 |
| EP | 0160449 | A1 | 11/1985 |
| EP | 0416915 | A2 | 3/1991 |
| EP | 0180520 | B1 | 5/1991 |
| EP | 679859 | A2 | 11/1995 |
| EP | 0482969 | B1 | 8/1996 |
| EP | 694157 | B1 | 8/2001 |
| EP | 2702349 | B1 | 11/2015 |
| EP | 2310616 | B1 | 10/2017 |
| EP | 3245380 | B1 | 4/2020 |
| GB | 2383236 | B | 1/2004 |
| GB | 2534484 | B | 4/2020 |
| JP | 2003329399 | A | 11/2003 |
| RU | 2295694 | C2 | 3/2007 |
| RU | 78521 | U1 | 11/2008 |
| RU | 93521 | U1 | 4/2010 |
| RU | 100552 | U1 | 12/2010 |
| RU | 2434122 | C2 | 11/2011 |
| RU | 2579307 | C1 | 4/2016 |
| RU | 2633904 | C1 | 10/2017 |
| WO | 8802056 | A1 | 3/1988 |
| WO | 1994009246 | A1 | 4/1994 |
| WO | 9905390 | A1 | 2/1999 |
| WO | 0133029 | A3 | 5/2001 |
| WO | 0159401 | A1 | 8/2001 |
| WO | 2001059401 | A1 | 8/2001 |
| WO | 2008067771 | A1 | 6/2008 |
| WO | 2008098052 | A3 | 10/2008 |
| WO | 2009091422 | A2 | 7/2009 |
| WO | 2009091422 | A3 | 3/2010 |
| WO | 2010104634 | A2 | 9/2010 |
| WO | 2012006357 | A2 | 1/2012 |
| WO | 2012106640 | A3 | 11/2012 |
| WO | 2012149584 | A1 | 11/2012 |
| WO | 2014046670 | A1 | 3/2014 |
| WO | 2014089194 | A1 | 6/2014 |
| WO | 2015006869 | A1 | 1/2015 |
| WO | 2015028204 | A2 | 3/2015 |
| WO | 2015134719 | A1 | 9/2015 |
| WO | 2016100269 | A1 | 6/2016 |
| WO | 2018009223 | A1 | 1/2018 |
| WO | 2018057949 | A1 | 3/2018 |
| WO | 2019148009 | A2 | 8/2019 |
| WO | 2021116338 | A1 | 6/2021 |
| WO | 2022084363 | A1 | 4/2022 |

OTHER PUBLICATIONS

Schlumberger; Field Test Database Print Out Showing uses of the SafeJet System; dated May 11, 2015; 10 pages.

Schlumberger; Selective Perforation: A Game Changer in Perforating Technology—Case Study; issued 2012; 14 pages.

Sharma, Gaurav; Hunting Plc Is Not In A Race To The Bottom, Says Oilfield Services Firm's CEO; dated Sep. 10, 2019; retrieved on Nov. 18, 2020; 6 pages.

SIPO, Search Report dated Mar. 29, 2017, in Chinese: See Search Report for CN App. No. 201480040456.9, 12 pgs. (English Translation 3 pgs.).

Smithson, Anthony; Declaration Declaration for IPR2021-00082; dated Oct. 16, 2020; 2 pages.

Smylie, Tom, New Safe and Secure Detonators for the Industry's consideration, presented at Explosives Safety & Security Conference, Marathon Oil Co, Houston; Feb. 23-24, 2005, 20 pages.

State Intellectual Property Office People's Republic of China; First Office Action for Chinese App. No. 201811156092.7; dated Jun. 16, 2020; 6 pages (Eng Translation 8 pages).

State Intellectual Property Office, P.R. China; First Office Action for Chinese App No. 201580011132.7; dated Jun. 27, 2018; 5 pages (Eng. Translation 9 pages).

State Intellectual Property Office, P.R. China; First Office Action for CN App. No. 201480047092.7; dated Apr. 24, 2017.

State Intellectual Property Office, P.R. China; First Office Action with full translation for CN App. No. 201480040456.9; dated Mar. 29, 2017; 12 pages (English translation 17 pages).

State Intellectual Property Office, P.R. China; Notification to Grant Patent Right for Chinese App. No. 201580011132.7; dated Apr. 3, 2019; 2 pages (Eng. Translation 2 pages).

State Intellectual Property Office, P.R. China; Notification to Grant Patent Right for CN App. No. 201480040456.9; dated Jun. 12, 2018; 2 pages (English translation 2 pages).

State Intellectual Property Office, P.R. China; Second Office Action for CN App. No. 201480040456.9; dated Nov. 29, 2017; 5 pages (English translation 1 page).

State Intellectual Property Office, P.R. China; Second Office Action for CN App. No. 201480047092.7; dated Jan. 4, 2018; 3 pages.

Stifel; Why the Big Pause? Balancing Long-Term Value with Near-Term Headwinds. Initiating Coverage of Oilfield Svcs and Equipment; dated Sep. 10, 2018; 207 pages.

SWM International, LLC and Nextier Oil Completion Solutions, LLC; Petition for Post Grant Review PGR No. 2021-00097; dated Jul. 20, 2021; 153 pages.

SWM International, LLC; Exhibit B: DynaEnergetics' Infringement of U.S. Pat. No. 11,078,762 for Civil Action No. 6:21-cv-00804; dated Aug. 3, 2021; 22 pages.

SWM International; Drawing of SafeJet System; dated Jul. 20, 2021; 1 page.

SWM International; Photographs of SafeJet System; dated Jul. 20, 2021; 9 pages.

U.S. Patent Trial and Appeal Board, Institution of Inter Partes Review of U.S. Pat. No. 9,581,422, Case IPR2018-00600, Aug. 21, 2018, 9 pages.

United States District Court for the Southern District of Texas Houston Division, Case 4:19-cv-01611 for U.S. Pat. No. 9,581,422B2, Plaintiff's Complaint and Exhibits, dated May 2, 2019, 26 pgs.

United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.

(56) References Cited

OTHER PUBLICATIONS

United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States Patent and Trademark Office, Notice of Allowance for U.S. Appl. No. 29/729,981, dated Sep. 18, 2020, 9 pages.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Final Office Action of U.S. Appl. No. 16/359,540, dated Aug. 14, 2019, 9 pages.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Non-Final Office Action of U.S. Appl. No. 16/451,440, dated Oct. 24, 2019, 22 pages.
United States Patent and Trademark Office, Non-Final Office Action of U.S. Appl. No. 14/767,058, dated Jul. 15, 2016, 9 pages.
United States Patent and Trademark Office, Non-Final Office Action of U.S. Appl. No. 15/117,228, dated May 31, 2018, 9 pages.
United States Patent and Trademark Office, Non-Final Office Action of U.S. Appl. No. 15/617,344, dated Jan. 23, 2019, 5 pages.
United States Patent and Trademark Office, Non-Final Office Action of U.S. Appl. No. 15/788,367, dated Oct. 22, 2018, 6 pages.
United States Patent and Trademark Office, Non-Final Office Action of U.S. Appl. No. 15/920,800, dated Dec. 27, 2019, 6 pages.
United States Patent and Trademark Office, Non-Final Office Action of U.S. Appl. No. 15/920,812, dated Dec. 27, 2019, 6 pages.
United States Patent and Trademark Office, Non-Final Office Action of U.S. Appl. No. 15/920,812, dated May 27, 2020, 5 pages.
United States Patent and Trademark Office, Non-Final Office Action of U.S. Appl. No. 16/026,431, dated Jul. 30, 2019, 10 pages.
United States Patent and Trademark Office, Non-Final Office Action of U.S. Appl. No. 16/359,540, dated May 3, 2019, 11 pages.
International Searching Authority; International Search Report and Written Opinion for PCT App. No. PCT/EP2015/059381; dated Nov. 23, 2015; 14 pages.
International Searching Authority; International Search Report and Written Opinion for PCT App. No. PCT/EP2019/072064; dated Nov. 20, 2019; 15 pages.
International Searching Authority; International Search Report and Written Opinion for PCT App. No. PCT/US2015/018906; dated Jul. 10, 2015; 12 pages.
International Searching Authority; International Search Report and Written Opinion for PCT Application No. EP2020066327; dated Jan. 11, 2021; 17 pages.
International Searching Authority; International Search Report and Written Opinion of the International Searching Authority for PCT/EP2021/079019; dated Feb. 28, 2022; 14 pages.
International Searching Authority; International Search Report and Written Opinion of the International Searching Authority for PCT/EP2021/058182; dated Aug. 26, 2021; 16 pages.
International Searching Authority; International Search Report and Written Opinion of the International Searching Authority for PCT/EP2020/085624; dated Apr. 12, 2021; 11 pages.
International Searching Authority; International Search Report and Written Opinion of the International Searching Authority for PCT/EP2020/085622; dated Apr. 1, 2021; 10 pages.
International Searching Authority; International Search Report and Written Opinion of the International Searching Authority for PCT/EP2021/057148; dated Jul. 5, 2021; 11 pages.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Jet Research Centers, Capsule Gun Perforating Systems, Alvarado, Texas, 27 pgs., Jun. 12, 2019 https://www.jetresearch.com/content/dam/jrc/Documents/Books_Catalogs/07_Cap_Gun.pdf.
Johnson, Bryce; Citation of Prior Art and Written Statements in Patent Files for U.S. Pat. No. 10,844,697; dated Apr. 29, 2021; 2 pages.
Johnson, Bryce; Rule 501 citation of prior art and written "claim scope statements" in U.S. Pat. No. 10,844,697; dated Apr. 29, 2021; 18 pages.
Markel, Dan; Declaration regarding the SafeJet System for PGR2021-00097; dated Jul. 15, 2021; 21 pages.
Mcnelis et al.; High-Performance Plug-and-Perf Completions in Unconventional Wells; Society of Petroleum Engineers Annual Technical Conference and Exhibition; Sep. 28, 2015.
merriam-webster.com, Insulator Definition, https://www.merriam-webster.com/dictionary/insulator, Jan. 31, 2018, 4 pages.
Nextier Completion Solutions; Plaintiffs Preliminary Invalidity Contentions for Civil Action No. 4:21-cv-01328; dated Jun. 30, 2021; 19 pages.
Nextier Oilfield Solutions Inc; Petition for Inter Partes Review No. IPR2021-00082; dated Oct. 21, 2020; 111 pages.
Nexus Perforating LLC; Answer to DynaEnergetics Europe GMBH and DynaEnergetics US Inc/'s Complaint and Counterclaims; dated Apr. 15, 2021; 10 pages.
Nexus Perforating LLC; Complaint and Demand for Jury Trial for Civil Case No. 4:20-cv-01539; dated Apr. 30, 2020; 11 pages.
Nexus Perforating LLC; Invalidity Contentions for Civil Action No. 4:21-cv-00280; dated Jun. 30, 2021; 44 pages.
Norwegian Industrial Property Office; Notice of Allowance for No. 20171759; dated Apr. 23, 2021; 2 pages.
Norwegian Industrial Property Office; Office Action and Search Report for No. 20160017; dated Jun. 15, 2017; 5 pages.
Norwegian Industrial Property Office; Office Action and Search Report for No. 20171759; dated Jan. 14, 2020; 6 pages.
Norwegian Industrial Property Office; Office Action for No. 20160017; dated Dec. 4, 2017; 2 pages.
Norwegian Industrial Property Office; Office Action for No. 20171759; dated Oct. 30, 2020; 2 pages.

(56) References Cited

OTHER PUBLICATIONS

Norwegian Industrial Property Office; Opinion for No. 20171759; dated Apr. 5, 2019; 1 page.
Oilfield Glossary; Definition of Perforating Gun; dated Feb. 26, 2013; 2 pages.
oilgasglossary.com; Definition of "sub"; dated Nov. 20, 2008; 1 page.
Olsen, Steve; Declaration regarding the SafeJet System for PGR2021-00097; dated Jul. 16, 2021; 25 pages.
Owen Oil Tools & Pacific Scientific; RF-Safe Green Det, Side Block for Side Initiation, Jul. 26, 2017, 2 pgs.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.com/owen/cms/docs/Canada/10A_erhsc-01.0-c.pdf.
Owen Oil Tools, Recommended Practice for Oilfield Explosive Safety, Presented at 2011 MENAPS Middle East and North Africa Perforating Symposium, Nov. 28-30, 2011, 6 pages.
Owens Oil Tools, E & B Select Fire Side Port Tandem Sub Assembly Man-30-XXX-0002-96, revised Dec. 2012, 9 pgs., https://www.corelab.com/owen/CMS/docs/Manuals/gunsys/MAN-30-XXX-0002-96-R00.pdf.
Parrot, Robert; Declaration, PGR 2020-00080; dated Aug. 11, 2020; 400 pages.
Parrott, Robert; Declaration for IPR2021-00082; dated Oct. 20, 2020; 110 pages.
Parrott, Robert; Declaration for PGR No. 2021-00078; dated May 10, 2021; 182 pages.
Patent Trial and Appeal Board; Decision Granting Patent Owner's Request for Rehearing and Motion to Amend for IPR2018-00600; dated Jul. 6, 2020; 27 pages.
PCT Search Report and Written Opinion, dated May 4, 2015: See Search Report and Written opinion for PCT Application No. PCT/EP2014/065752, 12 pgs.
Preiss Frank et al.; Lowering Total Cost of Operations Through Higher Perforating Efficiency while simultaneously enhancing safety; May 10, 2016; 26 pages.
Resilience Against Market Volatility Results Presentation; Exhibit 2015 of PGR No. 2020-00080; dated Jun. 30, 2020; 26 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Declaration for Civil Action No. 3:21-cv-00192-M; dated May 27, 2021; 42 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Salt Warren et al.; New Perforating Gun System Increases Safety and Efficiency; dated Apr. 1, 2016; 11 pages.
Scharf Thilo; Declaration for PGR2020-00080; dated Nov. 16, 2020; 16 pages.
Scharf, Thilo; Declaration for PGR2020-00072; dated Oct. 22, 2020; 13 pages.
United States Patent and Trademark Office, Non-Final Office Action of U.S. Appl. No. 16/455,816, dated Nov. 5, 2019, 17 pages.
United States Patent and Trademark Office, Notice of Allowance for U.S. Appl. No. 15/920,800, dated Jul. 7, 2020, 7 pages.
United States Patent and Trademark Office, Notice of Allowance for U.S. Appl. No. 16/585,790, dated Jun. 19, 2020, 16 pages.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
United States Patent and Trademark Office, U.S. Pat. No. 438,305A, dated Oct. 14, 1890 to T.A. Edison, 2 pages.
United States Patent and Trademark Office; Final Office Action of U.S. Appl. No. 16/809,729, dated Nov. 3, 2020; 19 pages.
United States Patent and Trademark Office; Ex Parte Quayle Action for U.S. Appl. No. 29/729,981; dated Jun. 15, 2020; 6 pages.
United States Patent and Trademark Office; Final Office Action for U.S. Appl. No. 16/540,484; dated Feb. 19, 2021; 12 pages.
United States Patent and Trademark Office; Final Office Action for U.S. Appl. No. 17/004,966; dated Mar. 12, 2021; 18 pages.
United States Patent and Trademark Office; Final Office Action of U.S. Appl. No. 16/540,484; dated Mar. 30, 2020; 12 pgs.
United States Patent and Trademark Office; U.S. Pat. No. 9,581,422 as of Aug. 23, 2017.
United States Patent and Trademark Office; Non-Final Office Action for U.S. Appl. No. 16/542,890; dated Nov. 4, 2019; 16 pages.
United States Patent and Trademark Office; Non-Final Office Action for U.S. Appl. No. 15/920,812; dated Feb. 3, 2021; 7 pages.
United States Patent and Trademark Office; Non-Final Office Action for U.S. Appl. No. 16/809,729; dated Jun. 22, 2021; 15 pages.
United States Patent and Trademark Office; Non-Final Office Action for U.S. Appl. No. 16/819,270; dated Feb. 10, 2021; 13 pages.
United States Patent and Trademark Office; Non-Final Office Action for U.S. Appl. No. 17/007,574; dated Jan. 29, 2021; 11 pages.
United States Patent and Trademark Office; Non-Final Office Action for U.S. Appl. No. 17/181,280; dated Apr. 19, 2021; 18 pages.
United States Patent and Trademark Office; Non-Final Office Action for U.S. Appl. No. 17/221,219; dated Jun. 17, 2021; 10 pages.
United States Patent and Trademark Office; Non-Final Office Action of U.S. Appl. No. 15/920,800; dated Dec. 9, 2020; 6 pages.
United States Patent and Trademark Office; Notice of Allowance for U.S. Appl. No. 29/733,080; dated Oct. 20, 2020; 9 pages.
United States Patent and Trademark Office; Notice of Allowance for U.S. Appl. No. 16/858,041; dated Oct. 22, 2020; 10 pages.
United States Patent and Trademark Office; Notice of Allowance for U.S. Appl. No. 29/733,325; dated Oct. 23, 2020; 7 pages.
United States Patent and Trademark Office; Notice of Allowance for U.S. Appl. No. 15/920,812, dated Aug. 18, 2020; 5 pages.
United States Patent and Trademark Office; Notice of Allowance for U.S. Appl. No. 16/387,696; dated Jan. 29, 2020; 7 pages.
United States Patent and Trademark Office; Notice of Allowance for U.S. Appl. No. 14/904,788; dated Jul. 6, 2016; 8 pages.
United States Patent and Trademark Office; Notice of Allowance for U.S. Appl. No. 16/379,341; dated Jan. 19, 2021; 8 pages.
United States Patent and Trademark Office; Notice of Allowance for U.S. Appl. No. 16/423,789; dated Jul. 23, 2020 7 pages.
United States Patent and Trademark Office; Notice of Allowance for U.S. Appl. No. 16/511,495; dated Dec. 15, 2020; 9 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 17/007,574; dated May 21, 2021; 8 pages.
United States Patent and Trademark Office; Notice of Allowance for U.S. Appl. No. 29/759,466; dated Feb. 11, 2021; 9 pages.
United States Patent and Trademark Office; Office Action for U.S. Appl. No. 17/004,966; dated Dec. 8, 2020; 30 pages.
United States Patent and Trademark Office; Office Action of U.S. Appl. No. 16/540,484, dated Aug. 20, 2020, 10 pgs.
United States Patent and Trademark Office; Prosecution History for U.S. Pat. No. 10,352,136 dated Jul. 16, 2019; 206 pages.
United States Patent and Trademark Office; Restriction Requirement for U.S. Appl. No. 17/007,574; dated Oct. 23, 2020; 6 pages.
United States Patent and Trial Appeal Board; Final Written Decision on IPR2018-00600; dated Aug. 20, 2019; 31 pages.
United States Patent Trial and Appeal Board; Decision Denying Institution of Post-Grant Review; PGR No. 2020-00072; dated Jan. 19, 2021; 38 pages.
United States Patent Trial and Appeal Board; Institution Decision for PGR 2020-00080; dated Feb. 12, 2021; 15 pages.

(56) References Cited

OTHER PUBLICATIONS

Vigor Petroleum; Perforating Gun Accessories Product Description; https://www.vigordrilling.com/completion-tools/perforating-gun-accessories.html; 2021; 1 page.
WIPO, International Search Report for International Application No. PCT/CA2014/050673, dated Oct. 9, 2014, 3 pgs.
WIPO, Written Opinion of International Searching Authority for PCT Application No. PCT/CA2014/050673, dated Oct. 9, 2014, 4 pgs.
Wooley, Gary R.; Declaration in Support of Petition for Post Grant Review of U.S. Pat. No. 10,844,697 for PGR2021-00097; dated Jul. 17, 2021; 90 pages.
Yellowjacket Oil Tools, LLC and G&H Diversified Manufacturing, LP; Defendants' Preliminaray Invalidity Contentions for Civil Action No. 6:20-cv-01110-ADA; dated May 6, 2021; 20 pages.
Amit Govil, Selective Perforation: A Game Changer in Perforating Technology—Case Study, presented at the 2012 European and West African Perforating Symposium, Schlumberger, Nov. 7-9. 2012, 14 pgs.
Austin Powder Company; A—140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
Bear Manufacturing, LLC; Defendant Bear Manufacturing, LLC's Answer, Affirmative Defenses and Counterclaim in response to Plaintiffs' Complaint for Civil Action No. 3:21-cv-00185-M; dated Mar. 22, 2021; 14 pages.
Brazilian Patent and Trademark Office; Search Report for BR Application No. BR112015033010-0; dated May 5, 2020; (4 pages).
Buche & Associates, P.C.; Rule 501 Citation of Prior Art and Written "Claim Scope Statements" in U.S. Pat. No. 10,844,697; dated Mar. 3, 2021; 24 pages.
Burndy, Bulkhead Ground Connector, Mechanical Summary Sheet, The Grounding Superstore, Jul. 15, 2014, 1 page, https://www.burndy.com/docs/default-source/cutsheets/bulkhead-connect.
C&J Energy Services; Gamechanger Perforating System Description; 2018; 1 pages.
C&J Energy Services; Gamechanger Perforating System Press Release; 2018; 4 pages.
Canadian Intellectual Property Office, Office Action for CA App. No. 2923860 dated Jul. 14, 2017, 3 pages.
Canadian Intellectual Property Office, Office Action for CA App. No. 2923860 dated Nov. 25, 2016, 3 pages.
Canadian Intellectual Property Office; Notice of Allowance for CA Appl. No. 2,821,506; dated Jul. 31, 2019; 1 page.
Canadian Intellectual Property Office; Office Action for CA Appl. No. 2,821,506; dated Mar. 21, 2019; 4 pages.
Canadian Intellectual Property Office; Office Action for CA Application No. 2,941,648; dated Mar. 15, 2021; 3 pages.
Canadian Intellectual Property Office; Office Action for CA Application No. 3,070,118; dated Mar. 16, 2021; 3 pages.
Canadian Intellectual Property Office; Office Action for CA Application No. 3040648; dated Nov. 18, 2020; 4 pages.
ControlFire User Manual; Exhibit No. 2005 of PGR No. 2020-00072; 2014; 56 pages.
Corelab Owen Oil Tools; Expendable Perforating Guns Description; https://www.corelab.com/owen/cms/docs/Canada/10A_erhsc-01.0-c.pdf; 2008; 7 pages.
Dalia Abdallah et al., Casing Corrosion Measurement to Extend Asset Life, Dec. 31, 2013, 14 pgs., https://www.slb.com/-/media/files/oilfield-review/2-casing-corr-2-english.
Djresource, Replacing Signal and Ground Wire, May 1, 2007, 2 pages, http://www.djresource.eu/Topics/story/110/Technics-SL-Replacing-Signal-and-Ground-Wire/.
drillingmatters.org; Definition of "sub"; dated Aug. 25, 2018; 2 pages.
Dynaenergetics Europe GMBH; Complaint and Demand for Jury Trial for Civil Action No. 4:21-cv-00280; dated Jan. 28, 2021; 55 pages.
Dynaenergetics Europe GMBH; Patent Owner's Preliminary Response for PGR2020-00072; dated Oct. 23, 2020; 108 pages.
Dynaenergetics Europe GMBH; Patent Owner's Preliminary Response for PGR2020-00080; dated Nov. 18, 2020; 119 pages.
Dynaenergetics Europe GMBH; Principal and Response Brief of Cross-Appellant for United States Court of Appeals case No. 2020-2163, -2191; dated Jan. 11, 2021; 95 pages.
Dynaenergetics Europe; Defendants' Preliminary Infringement Contentions for Civil Action No. 3:20-CV-00376; dated Mar. 25, 2021; 22 pages.
Dynaenergetics Europe; DynaEnergetics Celebrates Grand Opening of DynaStage Manufacturing and Assembly Facilities in Blum, Texas; dated Nov. 16, 2018; 3 pages.
Dynaenergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.
Dynaenergetics Europe; Exhibit B Invalidity Claim Chart for Civil Action No. 4:19-cv-01611; dated May 2, 2019; 52 pages.
Dynaenergetics Europe; Petition to Correct Inventorship in Patent under 37 C.F.R § 1.324; dated Oct. 13, 2020; 21 pages.
Dynaenergetics Europe; Plaintiffs' Local Patent Rule 3-1 Infringement Contentions for Civil Action No. 4:19-cv-01611; dated May 25, 2018; 10 Pages.
Dynaenergetics Europe; Plaintiffs' Pending Motion For Reconsideration for Civil Action No. 4:17-cv-03784; dated Jan. 21, 2021; 4 pages.
Dynaenergetics Europe; Plaintiffs' Preliminary Claim Constructions and Identification of Extrinsic Evidence Civil Action No. 4:17-cv-03784; dated Aug. 3, 2018; 9 pages.
Dynaenergetics Europe; Plaintiffs' Preliminary Infringement Contentions, Civil Action No. 6:20-cv-00069-ADA; dated Apr. 22, 2020; 32 pages.
Dynaenergetics Europe; Plaintiff's Preliminary Infringment Contentions Civil Action No. 3:21-cv-00192-M; dated Jun. 18, 2021; 15 pages.
Dynaenergetics Europe; Plaintiffs' Reply in Support of Motion to Dismiss and Strike for Civil Action No. 6:20-cv-00069-ADA; dated Apr. 29, 2020; 15 pages.
Dynaenergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
Dynaenergetics Europe; Plaintiffs' Response to Defendants' Answer to Second Amended Complaint Civil Action No. 6:20-cv-00069-ADA; dated May 26, 2020; 18 pages.
DynaEnergetics exhibition and product briefing; Exhibit 2006 of PGR No. 2020-00072; dated 2013; 15 pages.
Dynaenergetics GMBH & Co. KG, Patent Owner's Response to Hunting Titan's Petition for Inter Parties Review—Case IPR2018-00600, filed Dec. 6, 2018, 73 pages.
Dynaenergetics GmbH & Co. KG; Patent Owner's Precedential Opinion Panel Request for Case IPR2018-00600; Sep. 18, 2019, 2 pg.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
DynaStage Gun System; Exhibit 2009 of PGR No. 2020-00080; dated May 2014; 2 pages.

(56) References Cited

OTHER PUBLICATIONS

Entchev et al., Autonomous Perforating System for Multizone Completions, SPE 147296, Prepared for Presentation at Society of Petroleum Engineers (SPE) Annual Technical Conference and Exhibition held Oct. 30, 2011-Nov. 2, 2011, 7 pgs. https://www.onepetro.org/conference-paper/SPE-147296-MS.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Federal Institute of Industrial Property; Decision of Granting for RU Appl. No. 2016104882/03(007851); dated May 17, 2018; 15 pages (English translation 4 pages).
Federal Institute of Industrial Property; Decision on Granting a Patent for Invention Russian App. No. 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); dated Feb. 1, 2018; 6 pages (Eng. Translation 4 pages).
G&H Diversified Manufacturing LP; Petition for Post Grant Review PGR No. 2021-00078; dated May 10, 2021; 122 pages.
GB Intellectual Property Office, Combined Search and Examination Report for GB App. No. 1717516.7, dated Feb. 27, 2018, 6 pgs.
GB Intellectual Property Office, Combined Search and Examination Report for GB App. No. GB1700625.5, dated Jul. 7, 2017, 5 pages.
GB Intellectual Property Office, Examination Report for GB App. No. GB1600085.3, dated Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; dated Apr. 13, 2018; 3 pages.
GB Intellectual Property Office; Notification of Grant for GB Appl. No. 1717516.7; dated Oct. 9, 2018; 2 pages.
GB Intellectual Property Office; Office Action for GB App. No. 1717516.7; dated Feb. 27, 2018; 6 pages.
GB Intellectual Property Office; Search Report for GB. Appl. No. 1700625.5; dated Dec. 21, 2017; 5 pages.
Geodynamics; Perforating Catalog; dated Mar. 5, 2020; 218 pages; https://www.perf.com/hubfs/PDF%20Files/PerforatingCatalog_03272020_SMS.pdf.
German Patent Office, Office Action for German Patent Application No. 10 2013 109 227.6, which is in the same family as PCT Application No. PCT/EP2014/065752, see p. 5 for references cited, dated May 22, 2014, 8 pgs.
Gilliat et al.; New Select-Fire System: Improved Reliability and Safety in Select Fire Operations; 2012; 16 pgs.
Global Wireline Market; Exhibit 2010 of PGR 2020-00072; dated Oct. 15, 2019; 143 pages.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Energy Service, ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
Hunting Titan Inc.; Petition for Post Grant Review of U.S. Pat. No. 10,429,161; dated Jun. 30, 2020; 109 pages.
Hunting Titan Inc.; Petition for Post Grant Review of U.S. Pat. No. 10,472,938; dated Aug. 12, 2020; 198 pages.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-cv-03784; dated Jun. 11, 2018.
Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
Hunting Titan, H-1 Perforating System, Sep. 1, 2017, 3 pgs., http://www.hunting-intl.com/titan/perforating-guns-and-setting-tools/h-1%C2%AE-perforating-system.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Hunting Titan; Response to Canadian Office Action for CA App. No. 2,933,756; dated Nov. 23, 2017; 18 pages.
Industrial Property Office, Czech Republic; Office Action for CZ App. No. PV 2017-675; dated Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; dated Oct. 26, 2018; 2 pages.
Industrial Property Office, Czech Republic; Office Action; CZ App. No. PV 2017-675; dated Dec. 17, 2018; 2 pages.
Intellectual Property India, Office Action of IN Application No. 201647004496, dated Jun. 7, 2019, 6 pgs.
International Bureau; International Preliminary Report on Patentability for PCT Application #PCT/EP2019/063214; dated Dec. 24, 2020; 9 pages.
International Searching Authority, International Preliminary Report on Patentability for PCT App. No. PCT/EP2014/065752; dated Mar. 1, 2016, 10 pgs.
International Searching Authority, International Search and Written Opinion of International App. No. PCT/EP2020/058241, dated Aug. 10, 2020, 18 pgs.
International Searching Authority; Communication Relating to the Results of the Partial International Search for PCT/EP2020/070291; dated Oct. 20, 2020; 8 pages.
International Searching Authority; International Preliminary Report on Patentability for PCT Appl. No. PCT/CA2014/050673; dated Jan. 19, 2016; 5 pages.
International Searching Authority; International Preliminary Report on Patentability for PCT Application No. PCT/EP2019/069165; dated Jan. 28, 2021; 9 pages.
International Searching Authority; International Preliminary Report on Patentability for PCT Application No. PCT/IB2019/000569; dated Jan. 28, 2021; 8 pages.
International Searching Authority; International Search Report and Written Opinion for PCT App. No. PCT/CA2014/050673; dated Oct. 9, 2014; 7 pages.
G & H Diversified Manufacturing; Yellow Jacket Oil Tools Orienting Sub; Dec. 18, 2022; 6 pages; https://ghdiv.com/orienting-sub/.
International Searching Authority; International Preliminary Report on Patentability of the International Searching Authority for PCT/EP2021/057148; dated Sep. 29, 2022; 8 pages.

(56) References Cited

OTHER PUBLICATIONS

International Searching Authority; International Preliminary Report on Patentability of the International Searching Authority for PCT/EP2021/058182; dated Oct. 13, 2022; 10 pages.
International Searching Authority; International Search Report and Written Opinion of the International Searching Authority for PCT/EP2022/055191; dated May 20, 2022; 10 pages.

* cited by examiner

ALIGNMENT SUB AND PERFORATING GUN ASSEMBLY WITH ALIGNMENT SUB

CROSS REFERENCE TO RELATED APPLICATIONS

This application is a bypass continuation application of International Application No. PCT/EP2021/058182 filed Mar. 29, 2021, which claims priority to U.S. patent application Ser. No. 17/206,416, filed Mar. 19, 2021 (issued as U.S. Pat. No. 11,339,614 on May 24, 2022) and U.S. Provisional Application No. 63/002,507 filed Mar. 31, 2020, the contents of each of which are incorporated herein by reference.

BACKGROUND OF THE DISCLOSURE

Wellbore tools used in oil and gas operations, including perforation guns housing shaped charges, are often sent down a wellbore in tool strings connected together to reduce time and costs associated with the operation. Sub-assemblies connect adjacent wellbore tools to one another to form the tool string.

Hydraulic fracturing produces optimal results when perforations are oriented in the direction of maximum principle stress or the preferred fracture plane (PFP). Perforations oriented in the direction of the PFP create stable perforation tunnels and transverse fractures (perpendicular to the wellbore) that begin at the wellbore face and extend far into the formation. However, if fractures are not oriented in the direction of maximum stress, tortuous, non-transverse fractures may result, creating a complex near-wellbore flow path that can affect the connectivity of the fracture network, increase the chance of premature screen-out, and impede hydrocarbon flow. A wellbore tool string including perforating guns may frequently rest on a lower horizontal surface of a wellbore casing. This positioning may result in larger perforations being formed by shaped charges oriented toward the nearby horizontal surface, and smaller perforations being formed by shaped charges oriented away from the nearby horizontal surface.

Accordingly, there is a need for an alignment sub that allows alignment of the phasing of shaped charges in two or more adjacent perforation guns connected on a tool string. Further, there is a need for an orienting alignment sub assembly for orienting a wellbore tool with aligned shaped charges in a wellbore so consistently sized perforations may be formed by shaped charges oriented in different directions.

BRIEF DESCRIPTION

An exemplary embodiment of an alignment sub may include a first sub body, a bulkhead body, a first bulkhead pin and a second bulkhead pin, a bulkhead retainer, and a second sub body. The first sub body may have a first sub body first end and a first sub body second end opposite the first sub body first end. The first sub body may include a first sub body first inner surface, a first sub body second inner surface, and a first sub body recess wall. T first sub body first inner surface may define a first sub body first bore extending from the first sub body second end towards the first sub body first end. The first sub body second inner surface may define a first sub body second bore extending from the first sub body first bore toward the first sub body first end. The first sub body recess wall may extend radially between the first sub body first inner surface and the first sub body second inner surface. The bulkhead body may be in the first sub body second bore. The bulkhead body may include a bulkhead o-ring compressively engaged with an interior surface of the first sub body radially adjacent to the first sub body second bore. A first bulkhead pin and a second bulkhead pin may extend from either end of the bulkhead body. A bulkhead retainer positioned in the first sub body first bore adjacent the first sub body recess wall. The bulkhead retainer may be dimensionally configured to secure the bulkhead body within the first sub body second bore. The second sub body may have a second sub body first end and a second sub body second end opposite the second sub body first end. The second sub body may further include a second sub body first inner surface defining a second sub body first bore extending from the second sub body second end toward the second sub body first end. The first sub body may be rotatably coupled to the second sub body and a portion of the first sub body is positioned within the second sub body first bore.

An exemplary embodiment of a perforating gun assembly may include a first perforating gun housing, a first shaped charge provided within the first perforating gun housing, and an alignment sub coupled to the first perforating gun housing. The alignment sub may include a first sub body and a second sub body rotatably coupled to the first sub body.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
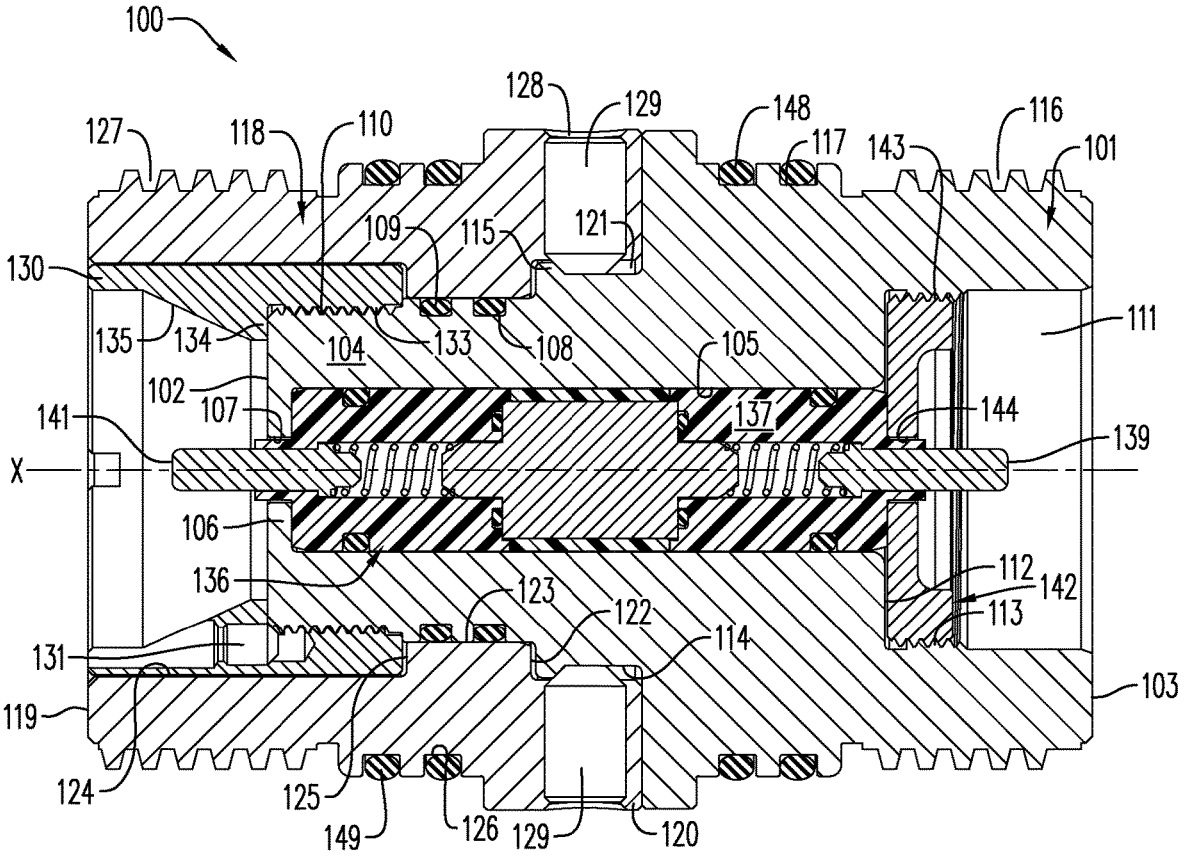
FIG. 1 is a cross-sectional view of an alignment sub according to an embodiment.
Figure 2:
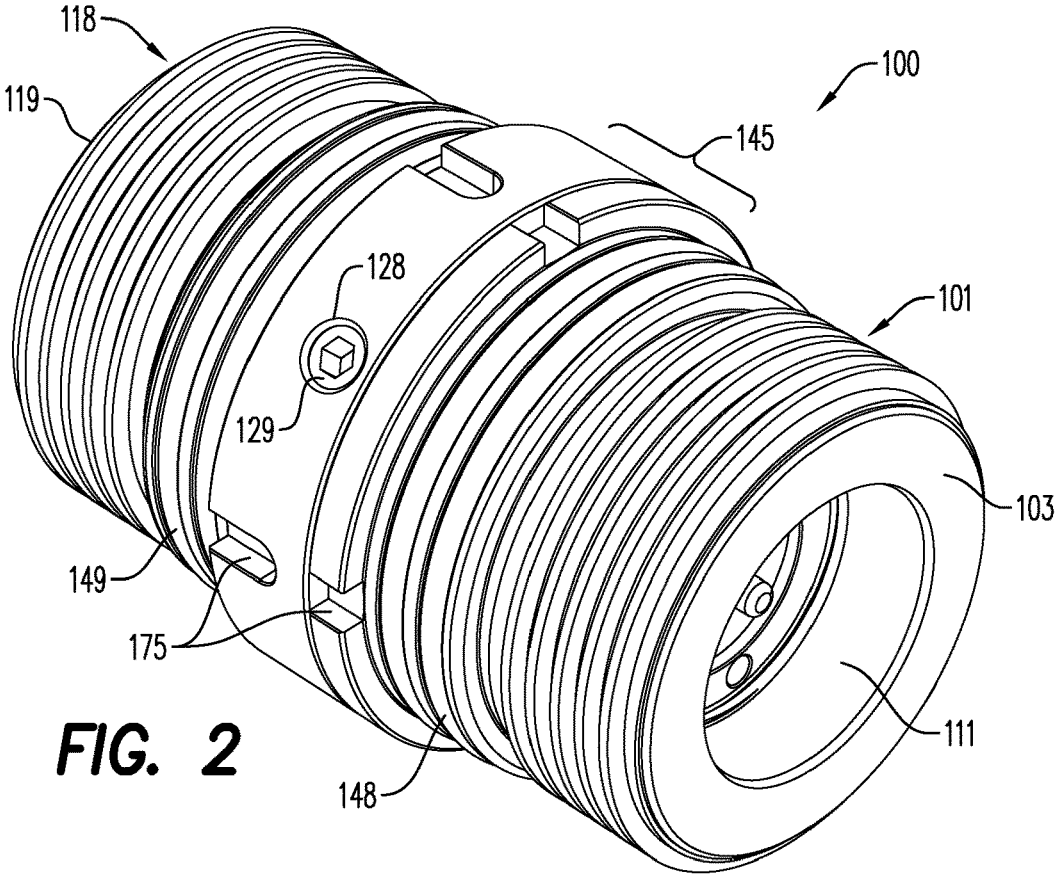
FIG. 2 is a perspective view of an alignment sub according to the embodiment shown in FIG. 1.
Figure 3:
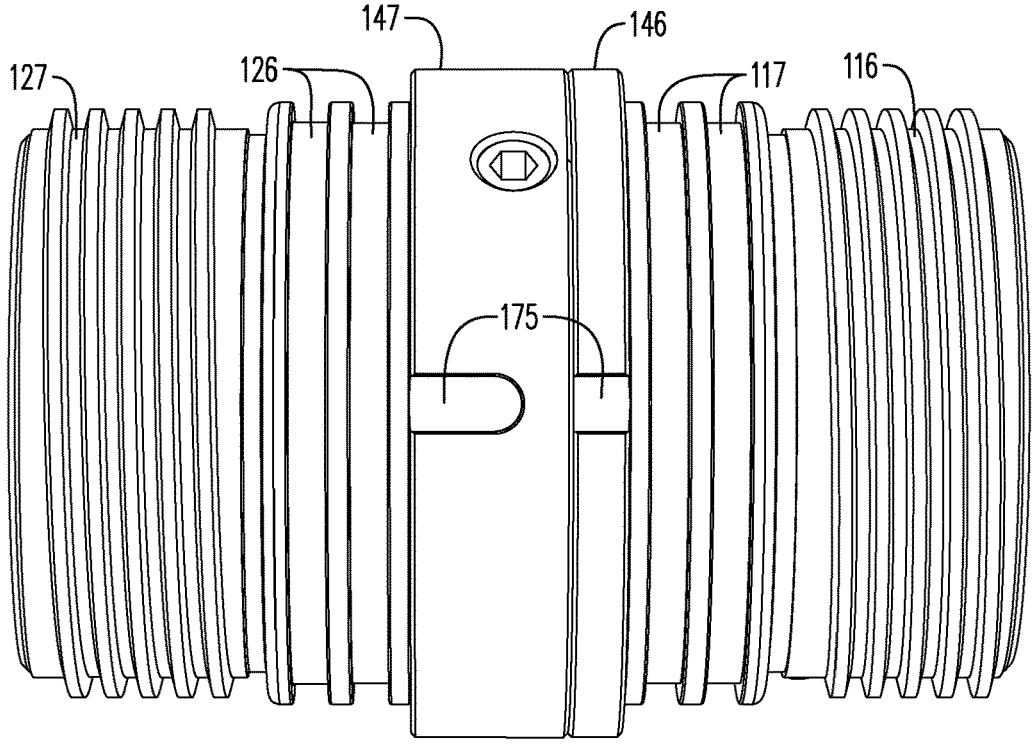
FIG. 3 is a side elevated view of an alignment sub according to the embodiment shown in FIG. 1.
Figure 4:
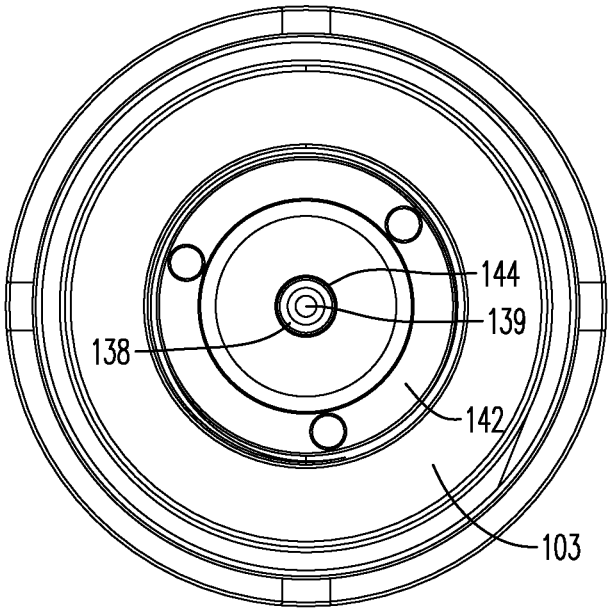
FIG. 4 is a front elevated view of an alignment sub according to the embodiment shown in FIG. 1.
Figure 5:
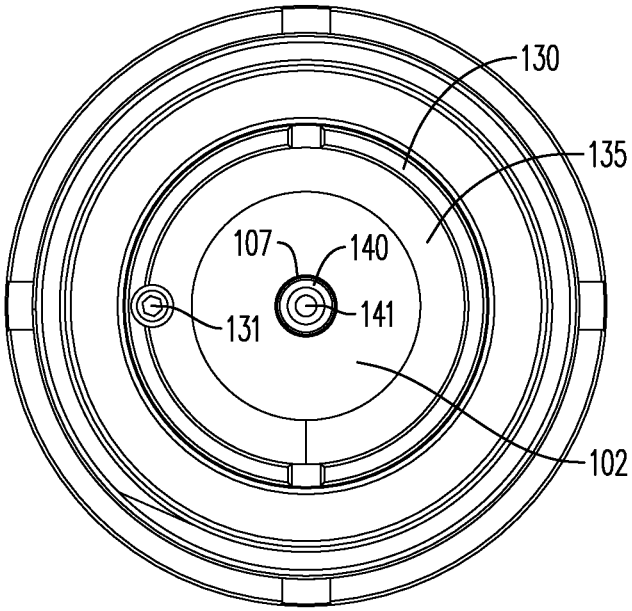
FIG. 5 is a rear elevated view of an alignment sub according to the embodiment shown in FIG. 1.
Figure 6:
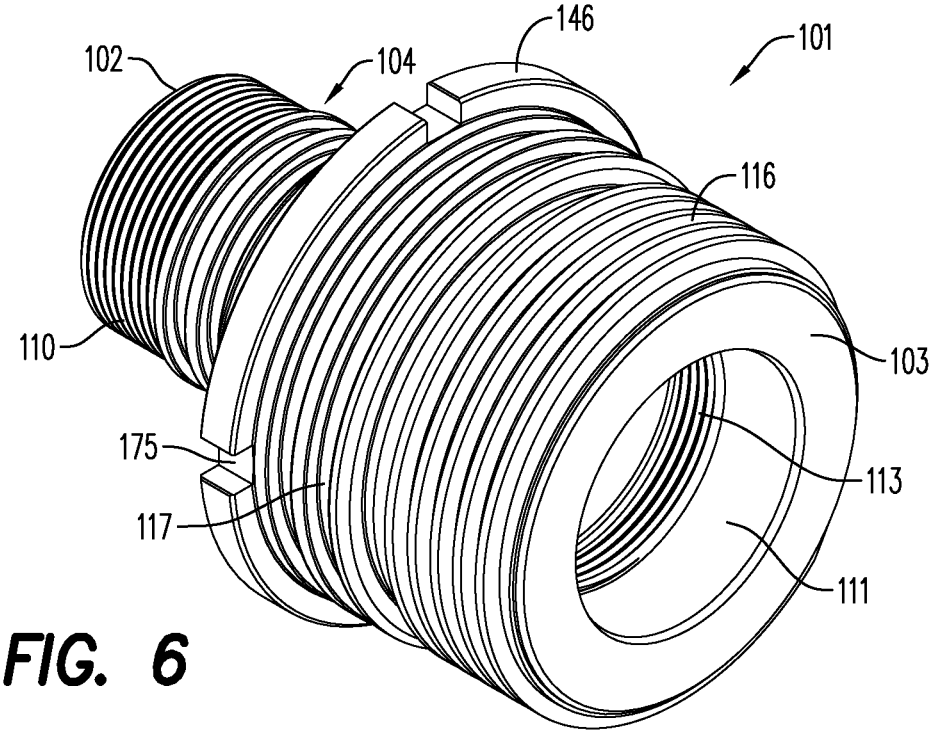
FIG. 6 is a front side perspective view of a first sub body part of an alignment sub according to an embodiment.
Figure 7:
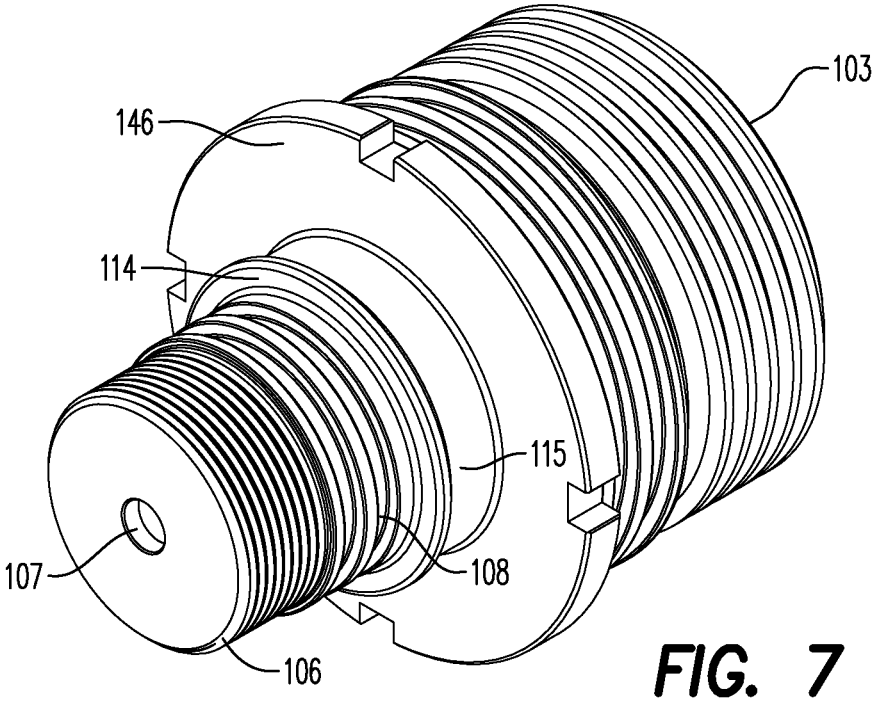
FIG. 7 is a rear side perspective view of a first sub body part of an alignment sub according to the embodiment shown in FIG. 6.
Figure 8:
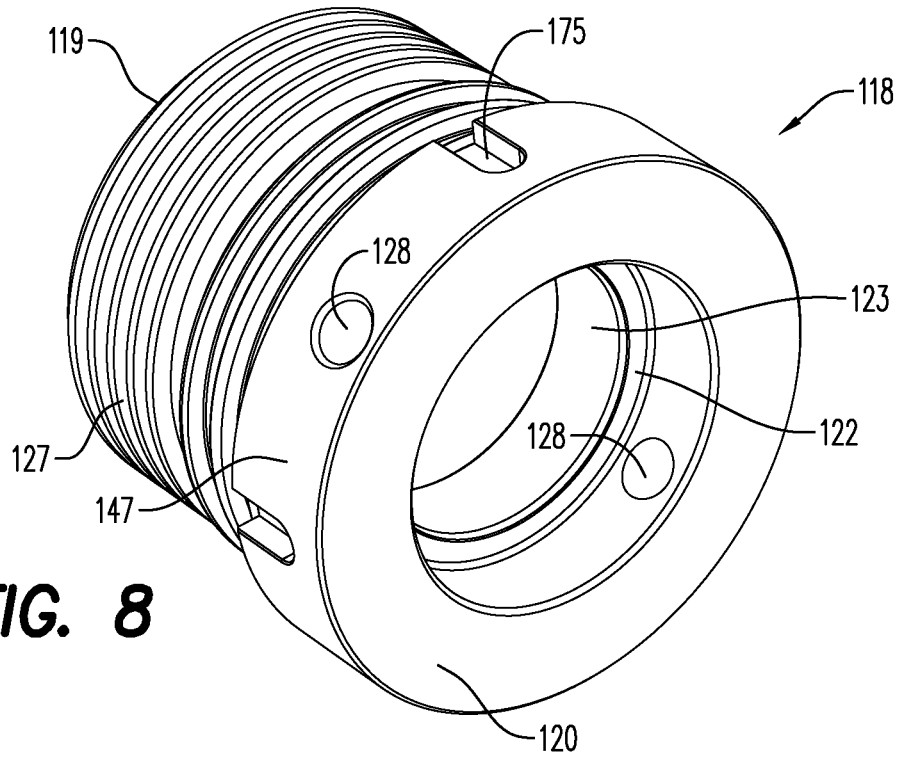
FIG. 8 is a front side perspective view of a second sub body part of an alignment sub according to an embodiment.
Figure 9:
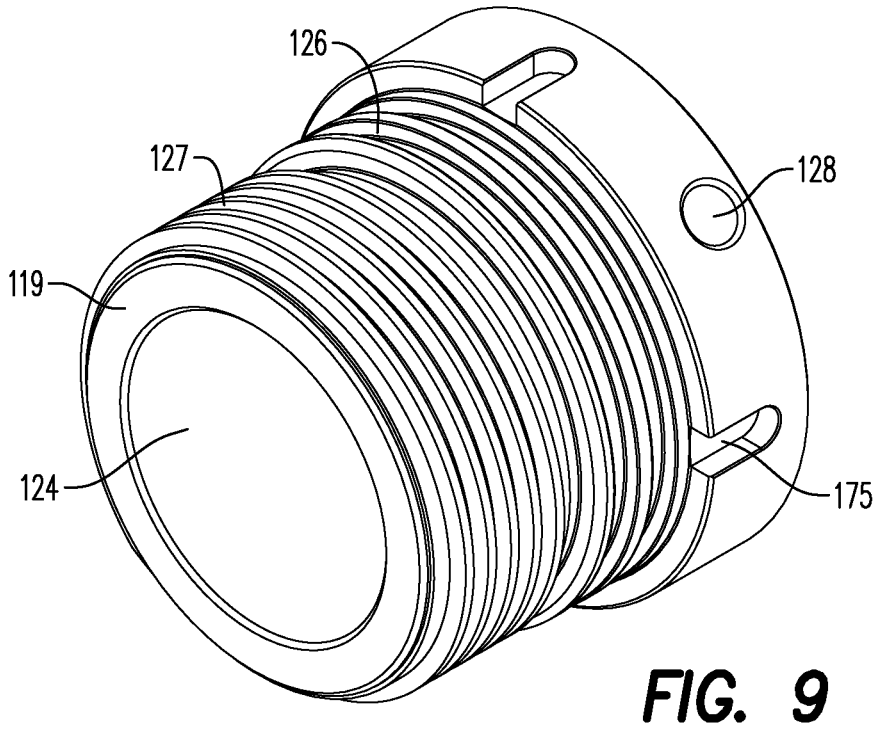
FIG. 9 is a rear side perspective view of a second sub body part of an alignment sub according to the embodiment shown in FIG. 8.
Figure 10:
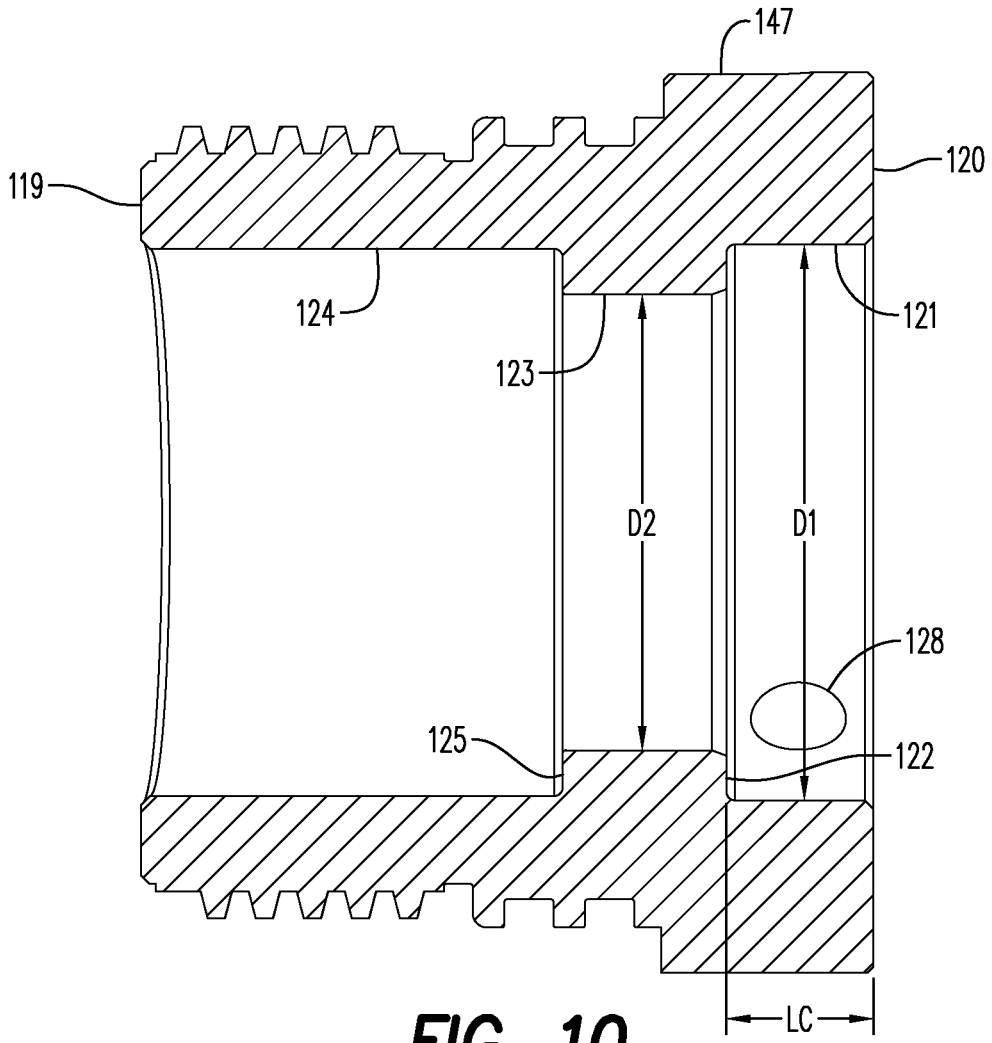
FIG. 10 is a cross-sectional side view of a second sub body part of an alignment sub according to the embodiment shown in FIGS. 8 and 9.
Figure 11:
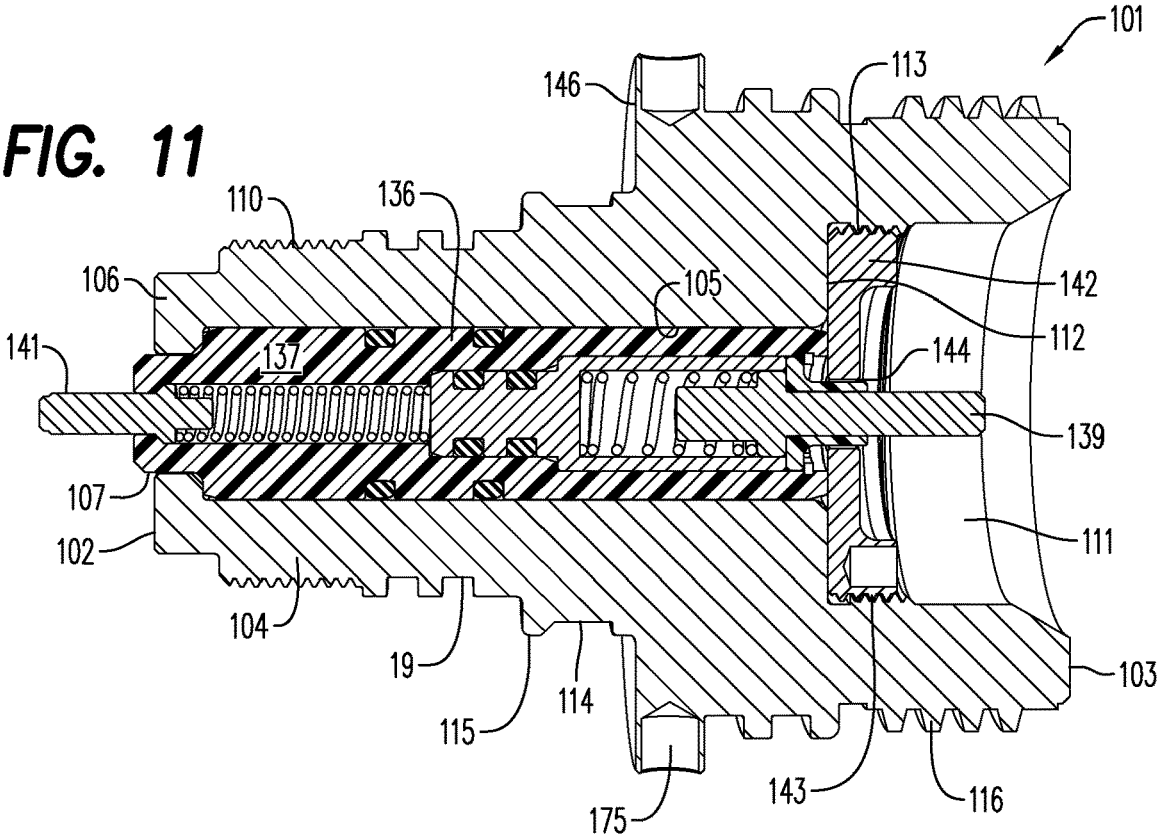
FIG. 11 is a cross-sectional side view of a partially assembled alignment sub according to an embodiment, showing a first sub body part.
Figure 12:
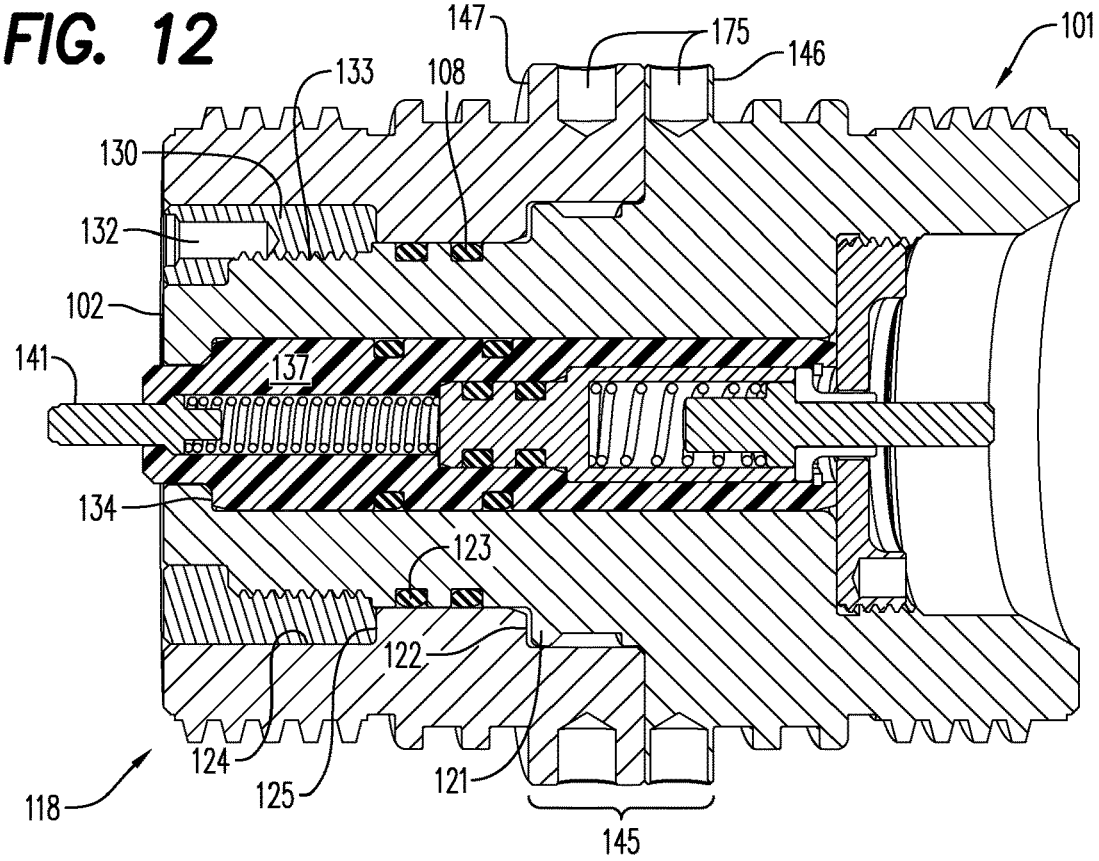
FIG. 12 is a cross-section side view of a partially assembled alignment sub according to the embodiment shown in FIG. 11, showing a first sub body part and a second sub body part.
Figure 13:
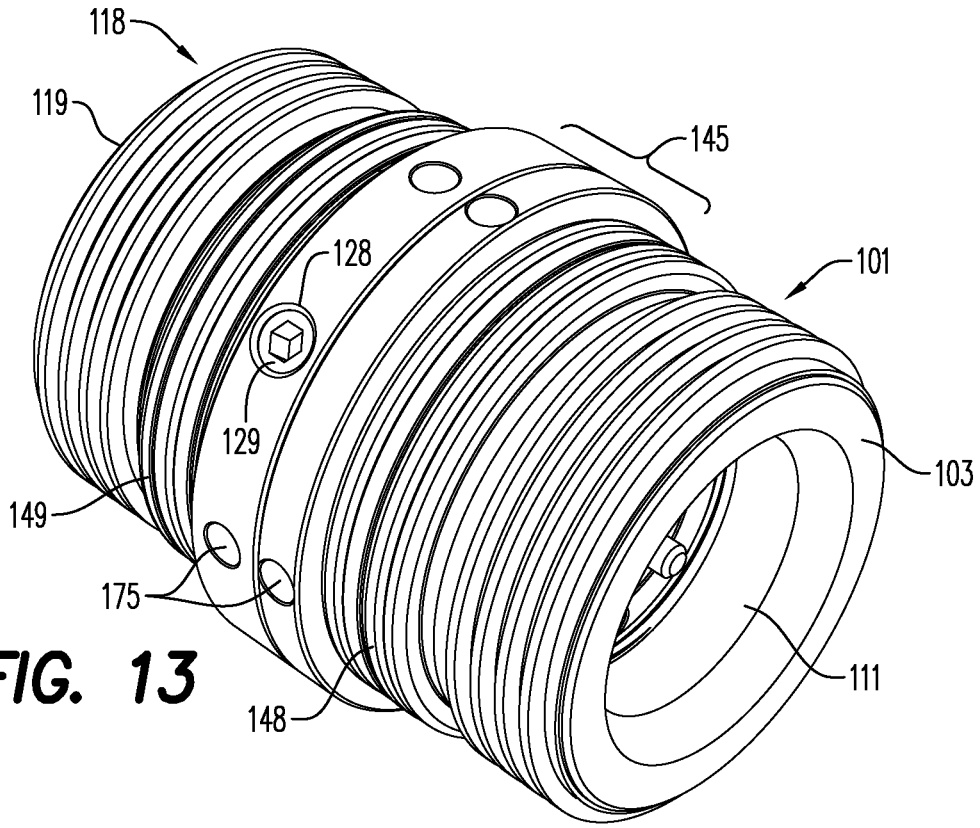
FIG. 13 is a perspective view of an alignment sub according to an embodiment.
Figure 14:
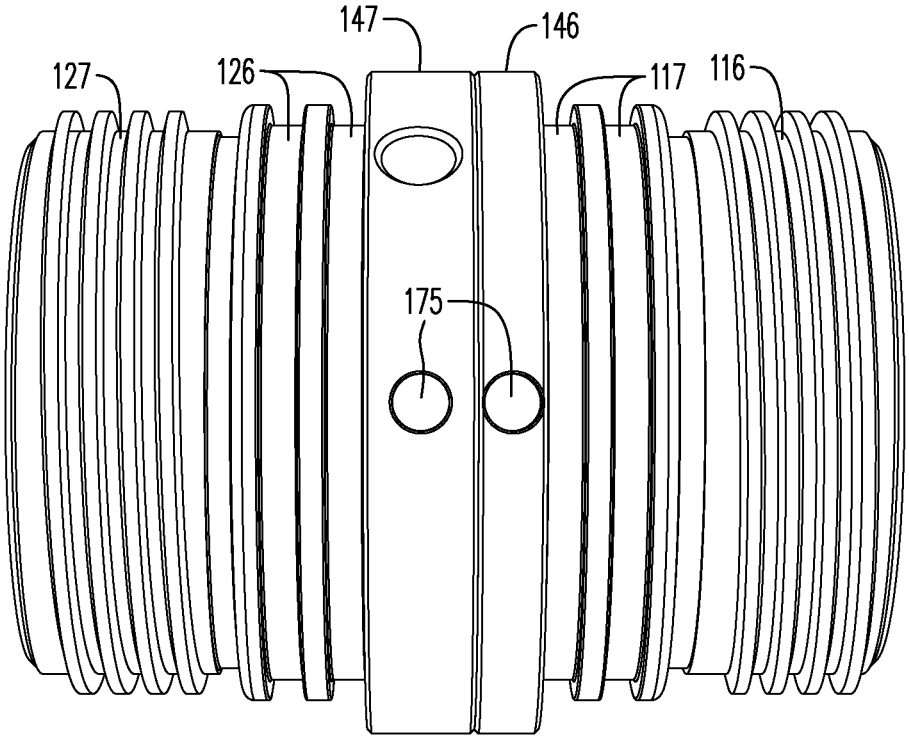
FIG. 14 is a side elevated view of an alignment sub according to the embodiment shown in FIG. 13.
Figure 15:
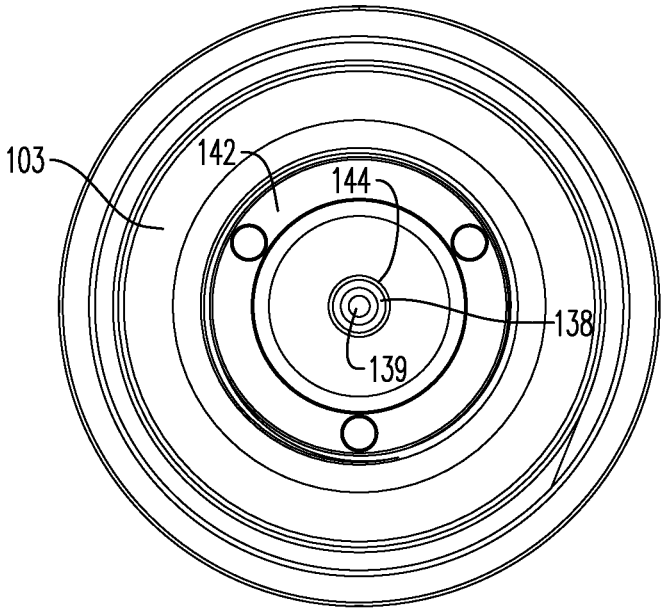
FIG. 15 is a front elevated view of an alignment sub according to the embodiment shown in FIG. 13.
Figure 16:
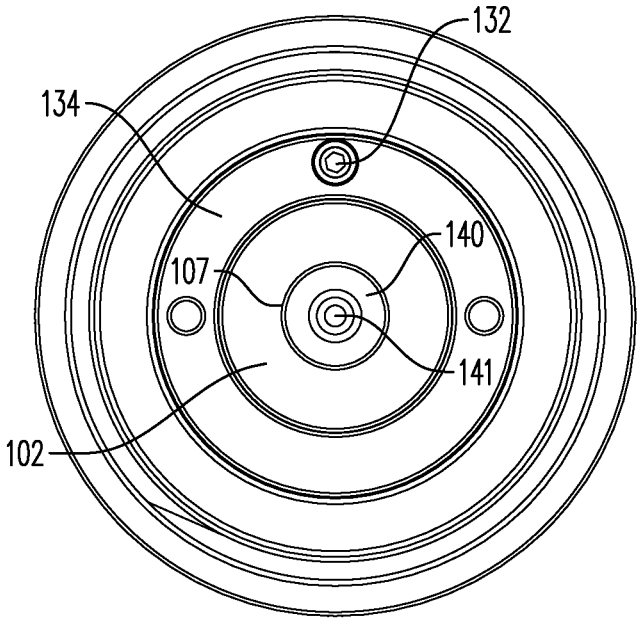
FIG. 16 is a rear elevated view of an alignment sub according to the embodiment shown in FIG. 13.
Figure 17:
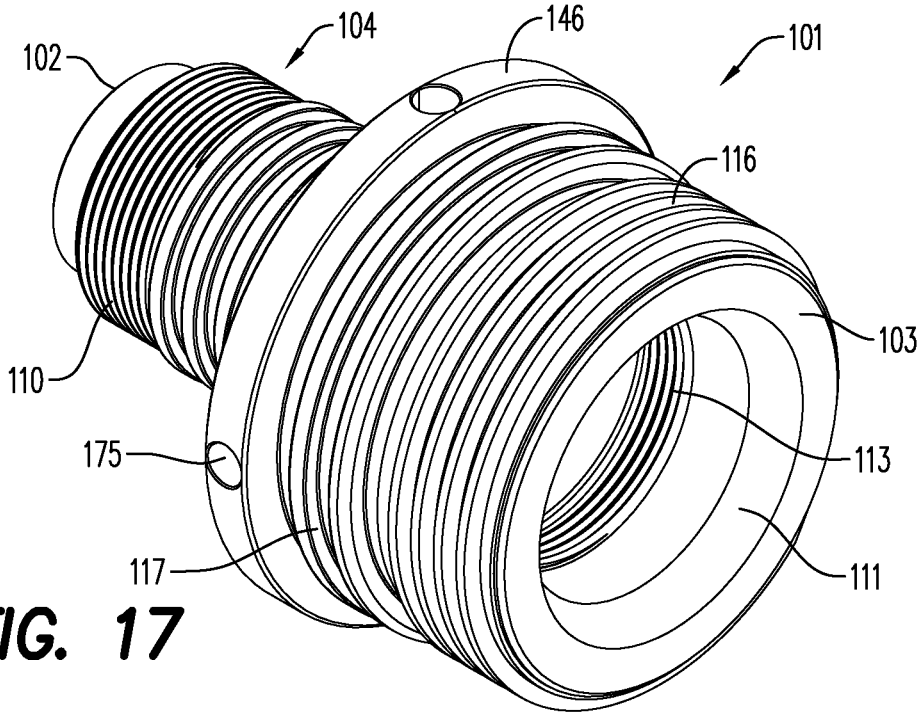
FIG. 17 is a front side perspective view of a first sub body part of an alignment sub according to an embodiment.
Figure 18:
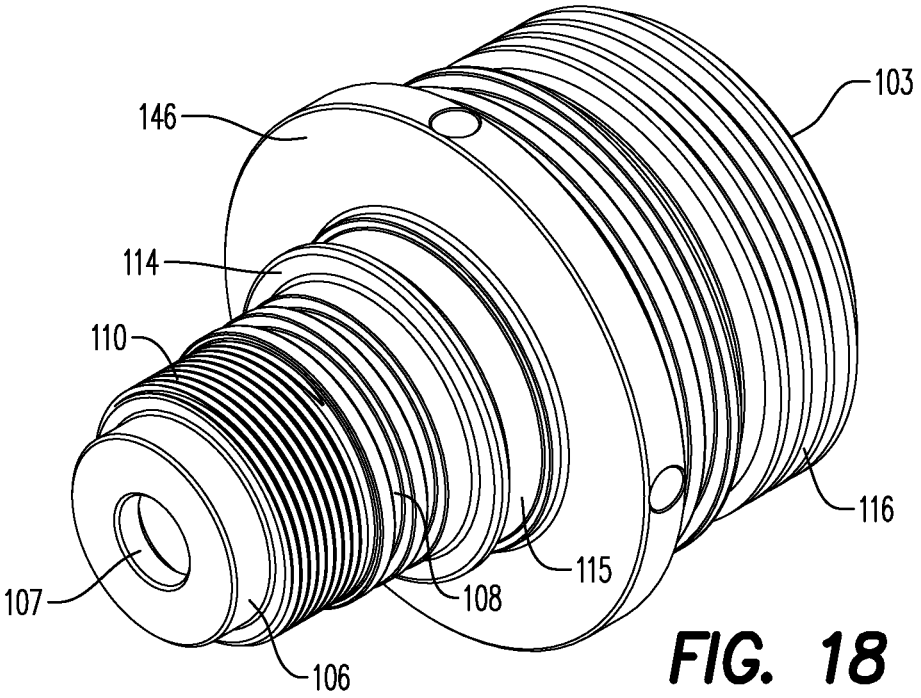
FIG. 18 is a rear side perspective view of a first sub body part of an alignment sub according to the embodiment shown in FIG. 17.
Figure 19:
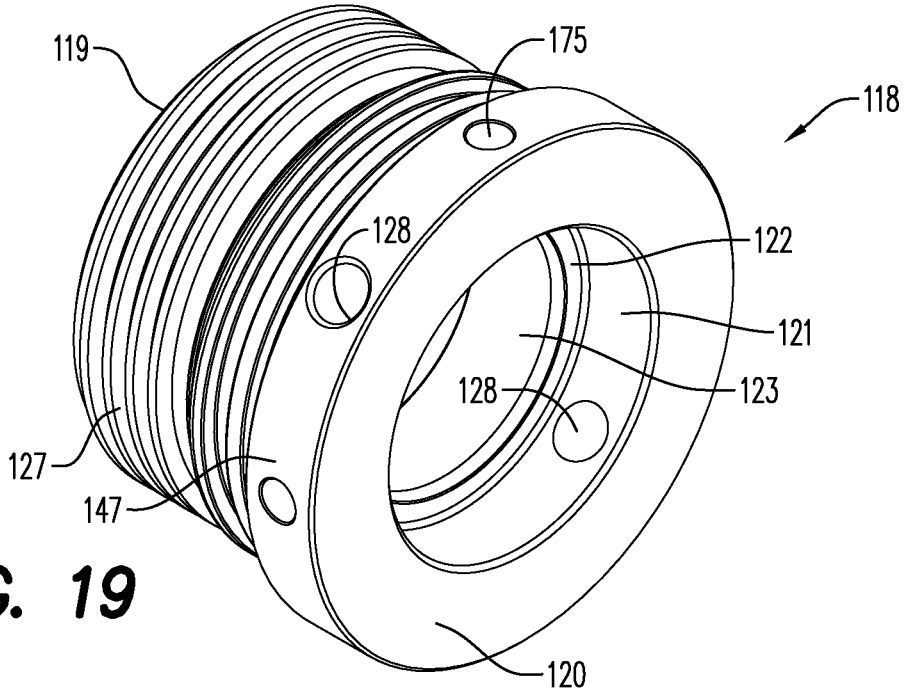
FIG. 19 is a front side perspective view of a second sub body part of an alignment sub according to an embodiment.
Figure 20:
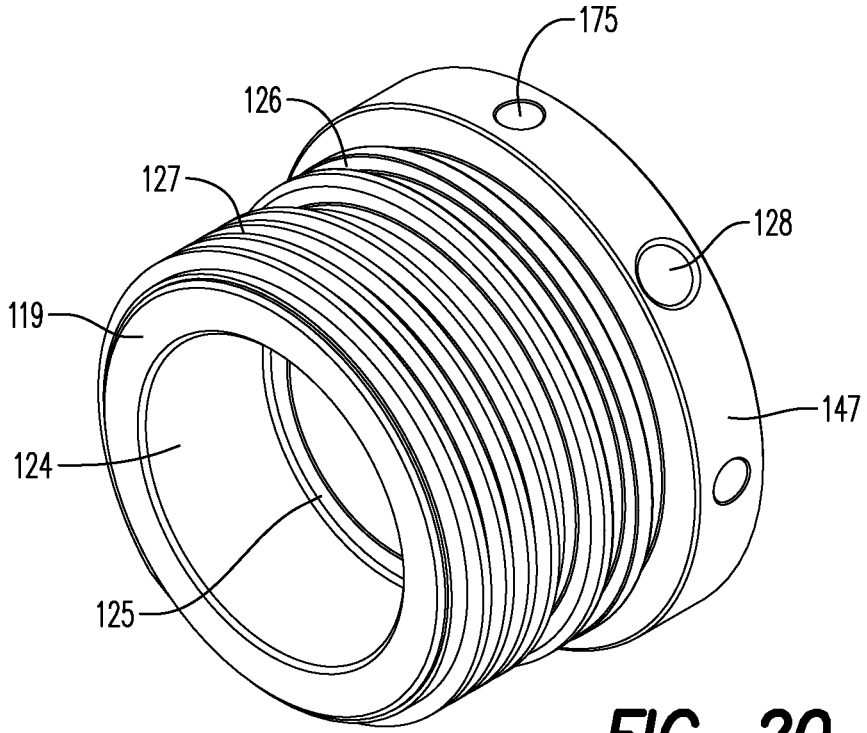
FIG. 20 is a rear side perspective view of a second sub body part of an alignment sub according to the embodiment shown in FIG. 19.
Figure 21:
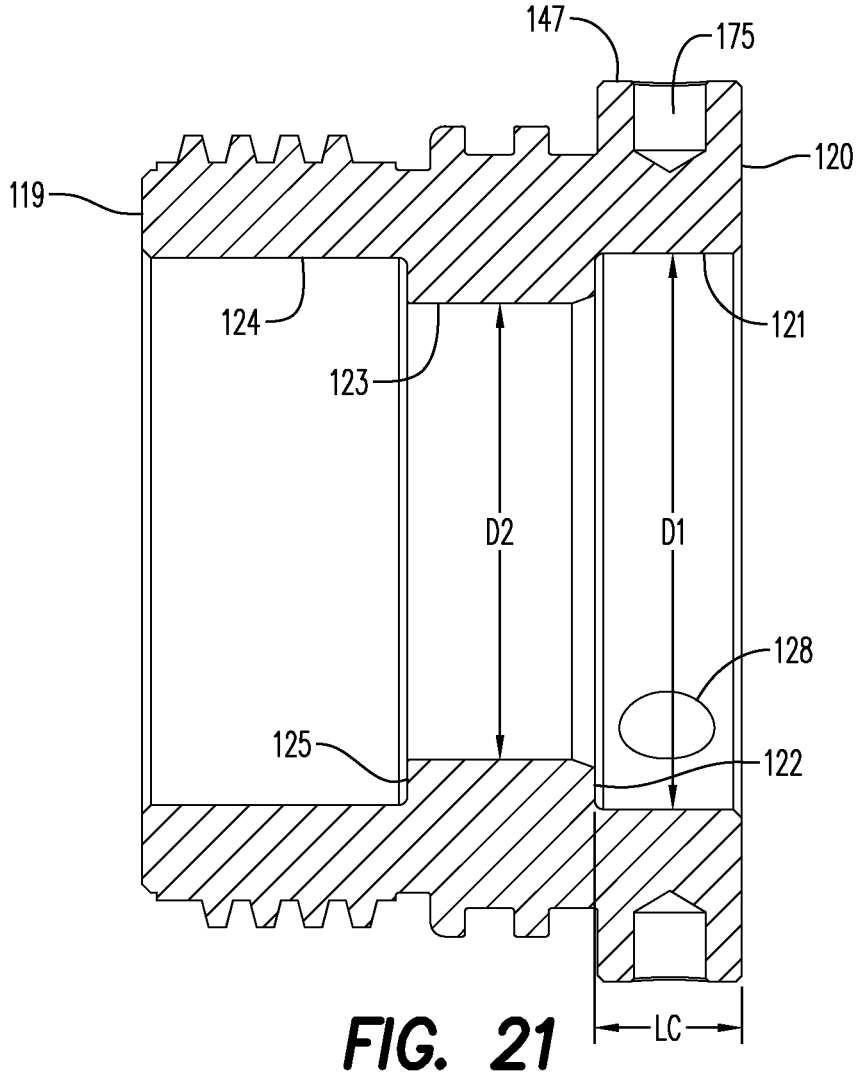
FIG. 21 is a cross-sectional side view of a second sub body part of an alignment sub according to the embodiment shown in FIGS. 19 and 20.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

FIGS. 1-10 show an exemplary embodiment of an alignment sub 100. The alignment sub 100 may include a first sub body part 101 and a second sub body part 118 rotatably coupled to the first sub body part 101.

With reference to FIGS. 1-4 and 6-7, the first sub body part 101 is shown in greater detail. The first sub body part 101 in the exemplary embodiment includes a first sub body part first end 102 and a first sub body part second end 103 spaced apart from the first sub body part first end 102. The first sub body part 101 includes an insertable portion 104 axially adjacent the first sub body part first end 102. A first sub body part bore 105 may extend in an x-direction along a central axis of rotation X (see FIG. 1) through a first sub body part insertable portion 104, between the first sub body part first end 102 and the first sub body part second end 103. According to an aspect, the first sub body part bore 105 has a bore longitudinal axis that is the central axis of rotation X of the alignment sub 100. In the exemplary embodiment shown in FIGS. 1-2, for example, a first sub body part recess 111 may extend from the first sub body part second end 103 to the first sub body part bore 105. The first sub body part bore 105 is defined on a first end by the first sub body part first end 102, and on a second end by a first sub body part recess wall 112. The first sub body part recess wall 112 extends radially between the first sub body part recess 111 and the first sub body part bore 105.

The first sub body part bore 105 may be dimensionally configured to receive an electrical assembly 136 for providing electrical conductivity through the length of the alignment sub 100. According to an aspect, the electrical assembly 136 is positioned in the first sub body part bore 105. The electrical assembly 136 may be, for example and not limitation, an electrically contactable bulkhead assembly including a bulkhead body 137 that is sealingly secured in the first sub body part bore 105. According to an aspect, the bulkhead body 137 may include a sealing element, such as a bulkhead o-ring (not labeled), for frictionally and compressively engaging with an interior surface 177 of the first sub body part 101 radially adjacent to the first sub body part bore 105. The frictional engagement pressure seals the bulkhead body 137 in the first sub body part bore 105.

Figure 25:
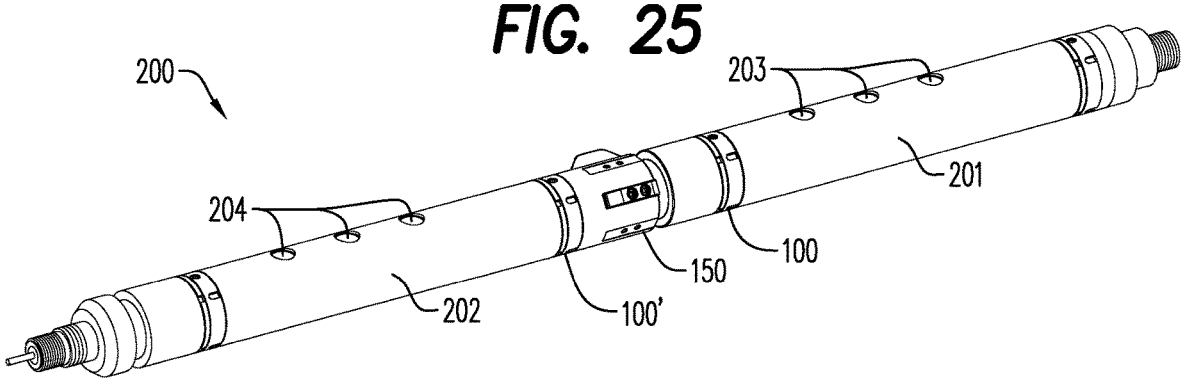
FIGS. 25 and 26 are perspective views of a perforating gun string according to an embodiment, including an orienting tandem seal adapter and alignment sub.

The electrical assembly 136, e.g., the bulkhead assembly 137, may include a bulkhead first end 138 including a first end bulkhead pin 139, and a bulkhead second end 140 including a second end bulkhead pin 141. The first end bulkhead pin 139 may be in electrical connection with the second end bulkhead pin 141. Each of the first end bulkhead pin 139 and second end bulkhead pin 141 are electrically contactable components. When used in a wellbore tool string to align a first wellbore tool 201 with a second wellbore tool 202 (see, e.g., FIG. 25), the first sub body part 101 may be non-rotatably coupled to a first wellbore tool 201, the second sub body part 118 may be non-rotatably coupled to a second wellbore tool 202, and the second sub body part 118 may be rotatably coupled to the first sub body part 101. The electrical assembly 136 positioned in the alignment sub 100 provides electrical conductivity through the alignment sub 100 from the first wellbore tool 201 to the second wellbore tool 202. The electrical assembly 136 provides electrical communication along a wellbore tool string when the first end bulkhead pin 139 is in contact with an electrically contactable component in a wellbore tool coupled to the second sub body part first end 119, and when the second end bulkhead pin 141 is in contact with an electrically contactable component in a wellbore tool coupled to the first sub body part second end 103.

Figure 26:
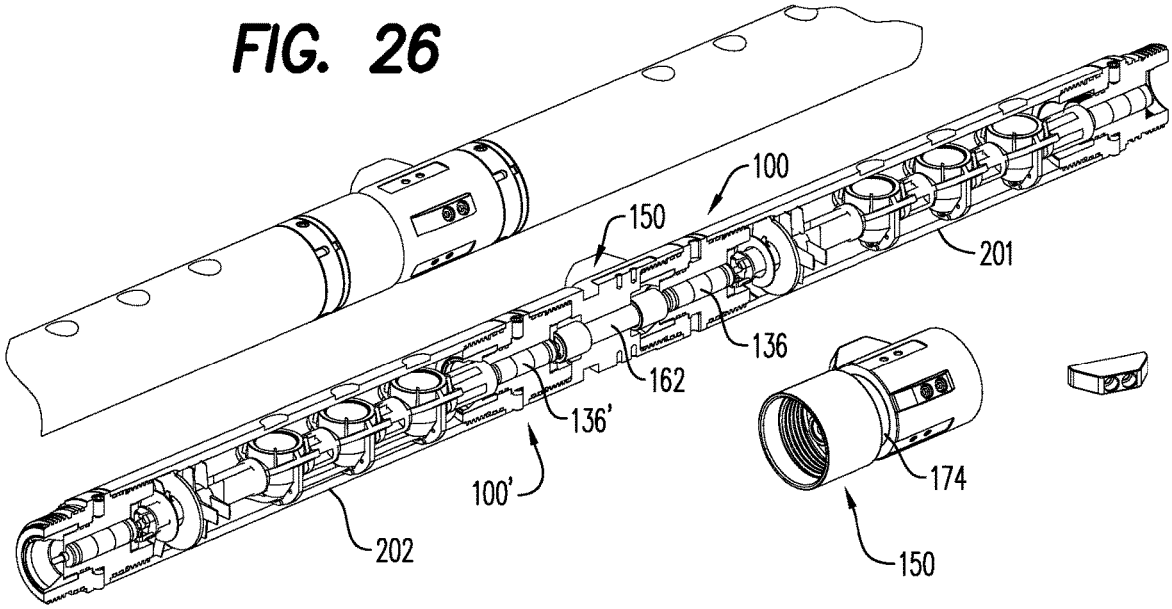

A bulkhead retainer nut 142 is positioned in the first sub body part recess 111 to secure the bulkhead assembly 137 in position in the first sub part bore 105. The bulkhead retainer nut 142 is positioned in the first sub body part recess 111 adjacent each of the first sub body part recess wall 112 and the first sub body part bore 105, and is dimensionally configured to contact an interior surface of the first sub body part 101 radially adjacent to the first sub body part recess 111. In the exemplary embodiment as shown in FIG. 1, the first sub body part 101 includes a threaded surface interior portion 113 that receives a threaded side surface 143 of the bulkhead retainer nut 142 in a threaded engagement so that the bulkhead retainer nut 142 is threadedly secured to the first sub body part 101. A bulkhead retainer nut aperture 144 is formed through the bulkhead retainer nut 142 such that the second end bulkhead pin 141 extends through the bulkhead retainer nut aperture 144. According to an aspect, the first sub body part recess 111 may be dimensionally configured to receive and house an end of an adjacent wellbore tool component, such as, for example and not limitation, an end of a shaped charge positioning device housed in a first wellbore tool 201 (see, e.g., FIG. 26). The second end bulkhead pin 141 of the bulkhead assembly 137 extends into the first sub body part recess 111. In the embodiment shown in FIG. 26, the first wellbore tool 201 is coupled to the first sub body part second end 103, such that an electrically contactable portion of the first wellbore tool 201 is in electrical contact with the second end bulkhead pin 141.

With continued reference to FIGS. 1-3 and 6-7, the first sub body part 101 in the exemplary embodiment includes on its first end 102 a first sub body part shoulder 106 formed adjacent the first end of the first sub body part bore 105. A first sub body part aperture 107 may be formed in the first sub body part shoulder 106, which may extend from the first sub body part bore 105 through the first sub body part shoulder 106. The first sub body part aperture 107 may have a diameter that is smaller than a diameter of the bulkhead body 137, so as to prevent the bulkhead body 137 from passing through the first sub body part bore 105. According to an aspect, the first sub body part aperture 107 is formed in the first sub body part shoulder 106 in alignment with the bulkhead first end 138, and the first end bulkhead pin 139 has a diameter that is less than the diameter of the first sub body part aperture 107 such that the first end bulkhead pin 139 extends through the first sub body part aperture 107 and into an interior of the second sub body part 118. According to an aspect, each of the bulkhead first end 138 and the first end bulkhead pin 139 may extend through the first sub body part aperture 107.

The second sub body part 118 in an exemplary embodiment is shown in FIGS. 1 and 8-10. The second sub body part 118 may include a second sub body part first end 119 and a second sub body part second end 120 spaced apart from the second sub body part first end 119. A second sub body part cavity 121 extends axially from the second sub body part second end 120 toward the second sub body part first end 119. According to an aspect, the second sub body part cavity 121 has a cavity longitudinal axis that is a central axis of rotation X of the alignment sub 100, such that the first sub body part bore 105 and the second sub body part cavity 121 are axially aligned. According to an aspect, a portion of the first sub body 101 is positioned within the second sub body part cavity 121.

In the exemplary embodiment, the second sub body part 118 may include a second sub body part medial channel 123 provided axially adjacent the second sub body part cavity 121 and away from the second sub body part second end 120. A second sub body part cavity wall 122 positioned away from the second sub body part second end 120 and extending inward in the second sub body part cavity 121 may separate the second sub body part cavity 121 from the second sub body part medial channel 123, such that the second sub body part cavity 121 has a first diameter D1, and the second sub body part medial channel 123 has a second diameter D2. According to an aspect, the first diameter D1 of the second sub body part cavity 121 is greater than the second diameter D2 of the second sub body part medial channel 123. The second sub body part 118 in an exemplary embodiment includes a second sub body part recess 124 formed adjacent the sub body part medial channel 123, extending in a x-direction from the second sub body part first end 119 toward the second sub body part second end 120 and the second sub body part cavity 121. The second sub body part recess 124 is separated from the second sub body part medial channel 123 by a second sub body part recess wall 125. According to an aspect, the diameter of the second sub body part recess 124 is greater than the second diameter D2 of the second sub body part medial channel 123. The second wellbore tool 202 is coupled to the second sub body part first end 119, such that an electrically contactable portion of the second wellbore tool 202 is in electrical contact with the first end bulkhead pin 139 (see FIG. 26).

In the exemplary embodiment, a second sub body part retainer ring 130 retains the first sub body part 101 inside the second sub body part 118. The second sub body part retainer ring 130 is engaged with an inner surface of the second sub body part 118 and with the first sub body part 101 to retain the position of the first sub body part 101 inside the second sub body part 118. The second sub body part retainer ring 130 extends from the second sub body part first end 119 to the second sub body part recess wall 125, and may include a retainer ring shoulder 134 that abuts the first sub body part first end 102. According to an aspect, the second sub body part retainer ring 130 is dimensionally configured to secure the first sub body part insertable portion 104 to the second sub body part 118. In the embodiment shown in FIGS. 1-10, the second sub body part retainer ring 130 includes a contoured inner wall 135 extending from the second sub body part first end 119 to the retainer ring shoulder 134. In a further embodiment, as shown in FIGS. 11-21, the second sub body part retainer ring shoulder 134 and the first sub body part first end 102 are abutting. According to an aspect, the first sub body part insertable portion 104 includes a threaded surface portion 110 positioned in the second sub body part recess 124.

The second sub body part retainer ring 130 includes a threaded collar 133 extending from the second sub body retainer ring shoulder 134 toward the second sub body part recess wall 125, wherein the threaded collar 133 is threadedly engaged with the threaded surface portion 110 to threadedly secure the first sub body part 101 in the second sub body part 118. With reference to FIGS. 1, 5, 12, and 16, a socket screw 131 is positioned in a second sub body part retainer ring screw socket 132 formed in the second sub body part retainer ring 130. According to an aspect, the second sub body part retainer ring screw socket 132 may rotationally fix the retainer ring 130 to the first sub body part 101. The retainer ring screw socket 132 in the exemplary embodiment at least partially abuts one of the first sub body part first end 102 and the first sub body part insertable portion 104.

A locking mechanism, such as a sub locking screw 129, in the alignment sub 100 is used to fix the relative angular/rotational position of the first sub body part 101 relative to an angular/rotational position of the second sub body part 118. According to an aspect, more than one sub locking screw 129 may be used to lock the position of the first sub body part 101 relative to the position of the second sub body part 118. According to an aspect, the sub locking screw 129 may be switchable between an unlocked state and a locked state such that, when the sub locking screw 129 is in the locked state, the angular position of the first sub body part 101 is fixed relative to an angular position of the second sub body part 118, and when the sub locking screw 129 is in the unlocked state, the second sub body part 118 is able to rotate relative to the first sub body part 101.

According to an aspect, the sub locking screw 129 is dimensionally configured to be secured in a locking screw socket 128 formed in a second sub body part rib 147. In the exemplary embodiment shown in FIG. 1, the second sub body part second end 120 is defined by a second sub body part rib 147 projecting from an outer surface of the second sub body part 118 and a sub locking screw socket 128 is formed in and extends through the second sub body part rib 147. The second sub body part second end 120/second sub body part rib 147 are positioned around a sub locking screw channel 114 formed in the first sub body part 101. The sub locking screw channel 114 in the exemplary embodiment overlaps with the sub locking screw socket 128 in an axial direction. In an unlocked state, the first sub body part 101 is able to rotate within the second sub body part cavity 121. In a locked state, the sub locking screw 129 is secured in the sub locking screw socket 128, such that an end of the sub locking screw 129 is secured in the sub locking screw channel. According to an aspect, the alignment sub 100 may include a plurality of locking screw sockets 128 spaced equidistantly about the second sub body part rib 147.

In the exemplary embodiment, the locking screw channel 114 includes a channel lip 115 that is formed on the first sub body part 101 axially adjacent to the locking screw channel 114. The channel lip 115 defines a boundary of the locking screw channel 114 in which the sub locking screw 129 is received and secured when the alignment sub 100 is in the locked state. According to an aspect, a diameter of the first sub body part 101 at the channel lip 115 is larger than a diameter of the first sub body part 101 at the locking screw channel 114. In the exemplary embodiment, the channel lip 115 extends outward from the first sub body part 101 and abuts the second sub body part cavity wall 122 to align the locking screw channel 114 with the sub locking screw socket 128 in the second sub body part rib 147 for locking the alignment sub 100 in the locked state.

The first sub body part 101 according to the exemplary embodiment is secured in the second sub body part cavity 121 and the second sub body part medial channel 123. According to an aspect, the first sub body part 101 includes an interior o-ring 109 positioned in an interior o-ring channel 108 extending around the first sub body part 101 at an axial position between the channel lip 115 and the sub body part first end 102, wherein the one o-ring 109 contacts and frictionally engages a surface of the second sub body part medial channel 123. The first sub body part 101 may also include a first sub body part rib 146 formed adjacent the locking screw channel 114, such that the first sub body part rib 146 abuts the second sub body part rib 147. The first sub body part rib 146 and second sub body part rib 147 together form a central alignment sub rib 145, and a placement tool hole 175 may be formed in each of the first sub body part rib 146 and the second sub body part rib 147 for positioning of the alignment sub 100 when coupled to adjacent wellbore tools as part of the wellbore tool string. According to an aspect, the placement tool holes 175 may be dimensioned and positioned on the first sub body part rib 146 and the second sub body part rib 147 as required by the particular application. The placement tool holes may be circular in shape, as shown in the embodiment of FIGS. 11-21. Alternatively, some or all of the placement tool holes 175 may be shaped in a horseshoe or arc-shaped configuration as shown in the embodiment of FIGS. 1-10.

In an exemplary embodiment, each of the first sub body part 101 and the second sub body part 118 include external threading for coupling to an adjacent wellbore tool to form a wellbore tool string. The first sub body part 101 includes a threaded exterior portion 116 that is dimensionally configured to couple to a first perforating gun housing of a first wellbore tool 201 (see FIG. 26). The second sub body part 118 includes a second sub body part threaded exterior portion 127 that is dimensionally configured to couple to a second perforating gun housing of a second wellbore tool 202.

In the exemplary embodiment, the first sub body part 101 includes a first sub body part external o-ring channel 117 having a first sub body part external o-ring 148 positioned therein, wherein the first sub body part external o-ring channel 117 is formed between the first sub body part rib 146 and the first sub body part threaded exterior portion 116. The second sub body part 118 may include a second sub body part external o-ring channel 126 having a second sub body part external o-ring 149 positioned therein, wherein the second sub body part external o-ring channel 126 is formed between the second sub body part rib 147 and the second sub body part threaded exterior portion 127.

Figure 22:
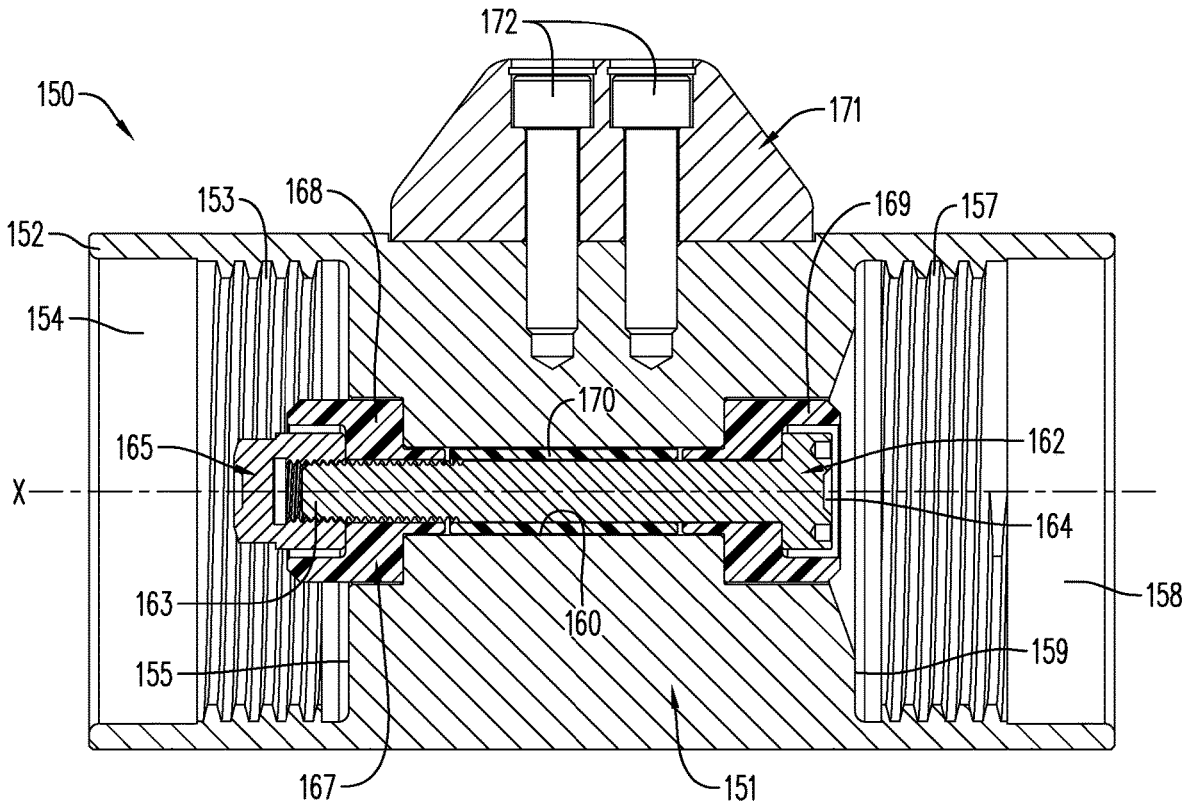
FIG. 22 is a cross-sectional side view of an orienting tandem seal adapter according to an embodiment.
Figure 23:
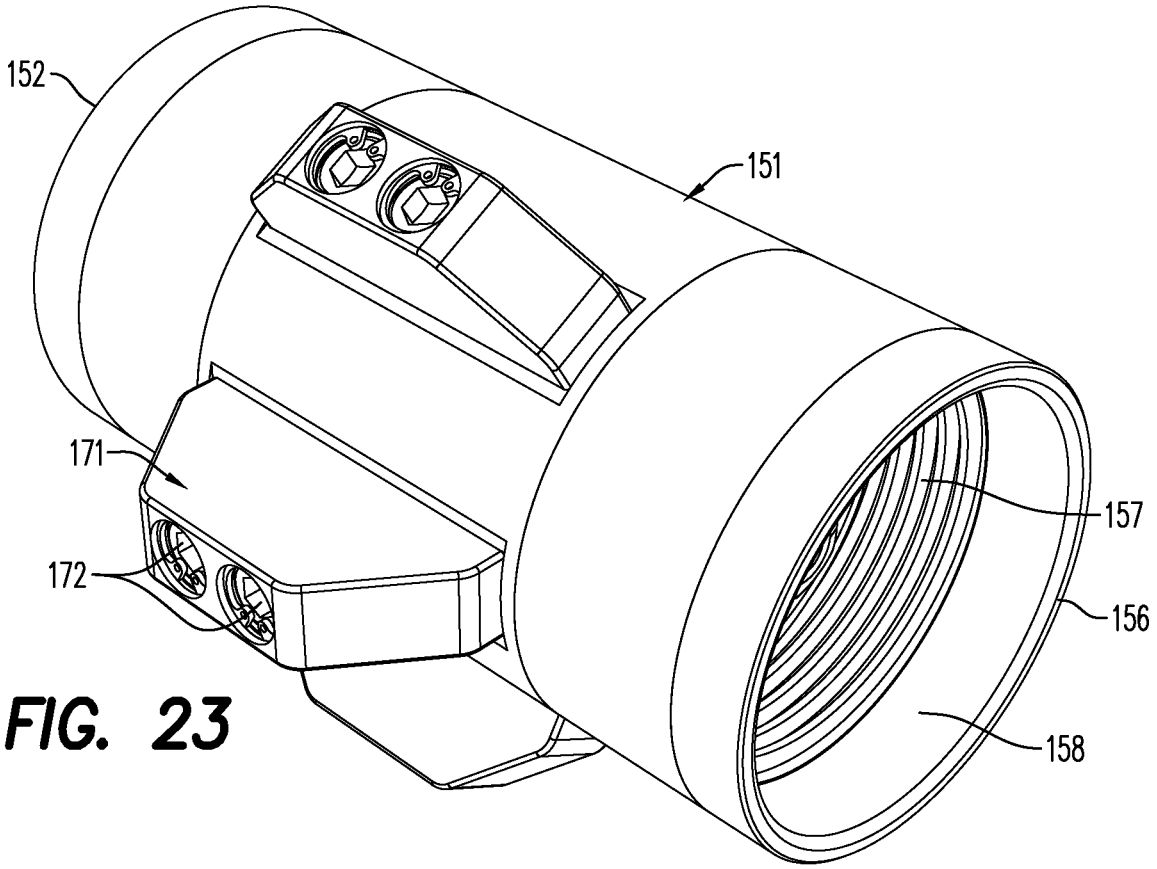
FIG. 23 is a perspective view of an orienting tandem seal adapter according to the embodiment shown in FIG. 22.
Figure 24:
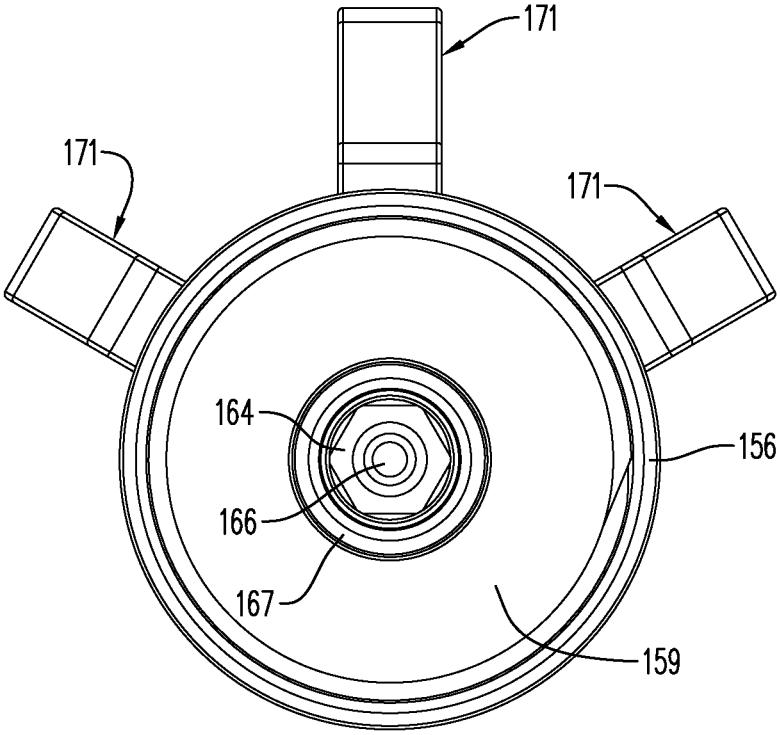
FIG. 24 is a front elevated view of an orienting tandem seal adapter according to the embodiment shown in FIG. 22.

With reference to FIGS. 22-26, a tandem seal adapter (TSA) 150 may be used in conjunction with one or more alignment subs 100, 100' in a wellbore tool string 200 to align adjacent wellbore tools 201, 202 and to provide orientation of the wellbore tool string 200 while in a wellbore. In an exemplary embodiment and as shown in FIG. 22, the TSA 150 includes an adapter body 151. The adapter body 151 may be a solid cylindrical body including a first end 152, a second end 156 spaced apart from the first end 152, and an adapter bore 160 extending axially through the adapter body 151. A first adapter body recess 154 defined by a first adapter body recess wall 155 extends inwardly from the first end 152, and a second adapter body recess 158 defined by a second adapter body recess wall 159 extends inwardly from the second end 156. The first adapter body recess 154 may have an inner threaded surface 153 for threaded engagement with an adjacent wellbore tool or sub, and the second adapter body recess 158 may have an inner threaded surface 157 for threaded engagement with an adjacent wellbore tool or sub. The adapter bore 160 extends from the first adapter body recess wall 155 to the second adapter body recess wall 159.

A feedthrough rod/contact rod 162 is positioned in the axial bore 160 of the adapter body 151. When the contact rod 162 is positioned in the bore 160, it is held in position by a retainer nut 165. Each of the contact rod 162 and the retainer nut 165 is formed from an electrically conductive material. With continued reference to FIG. 22, a contact rod first end 163 is positioned adjacent the first adapter body recess 154, and a contact rod second end 164 is positioned adjacent the second adapter body recess 158. In the exemplary embodiment shown in FIG. 24, the retainer nut 165 includes a retainer nut recession dimensionally configured to receive a bulkhead pin (e.g., a first end bulkhead pin 139 or a second end bulkhead pin 141 of the alignment sub 100) from an adjacent wellbore tool or an adjacent alignment sub 100. The contact rod second end 164 may include a contact rod recession 166 dimensionally configured to receive a bulkhead pin from an adjacent wellbore tool.

The contact rod 162 is electrically isolated from electrical contact with the adapter body 151 by a non-conductive 3-piece insulator 167 that extends around the contact rod between the contact rod first end 163 and the contact rod second end 164. The insulator/insulating jacket 167 in the exemplary embodiment includes a first end piece 168 positioned around the contact rod first end 163, a second end piece 169 positioned around the contact rod second end 164, and a medial piece 170 extending between the contact rod first end 163 and the contact rod second end 164.

Figure 27A:
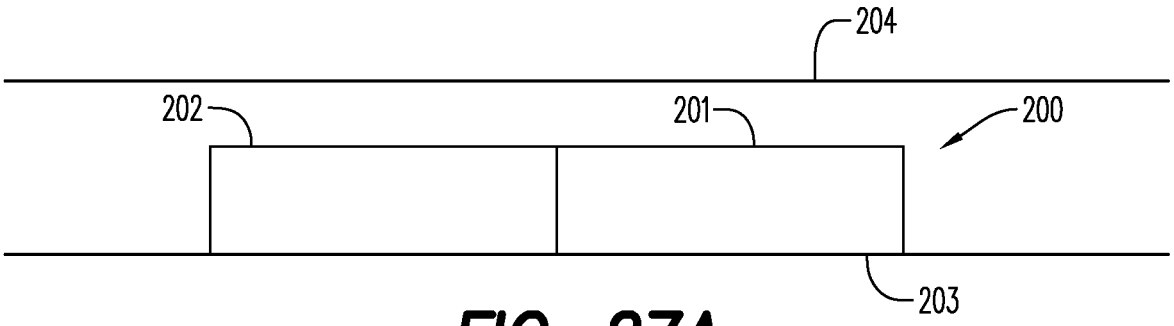
FIG. 27A shows a wellbore tool string positioned inside a wellbore casing according to an embodiment.
Figure 27B:
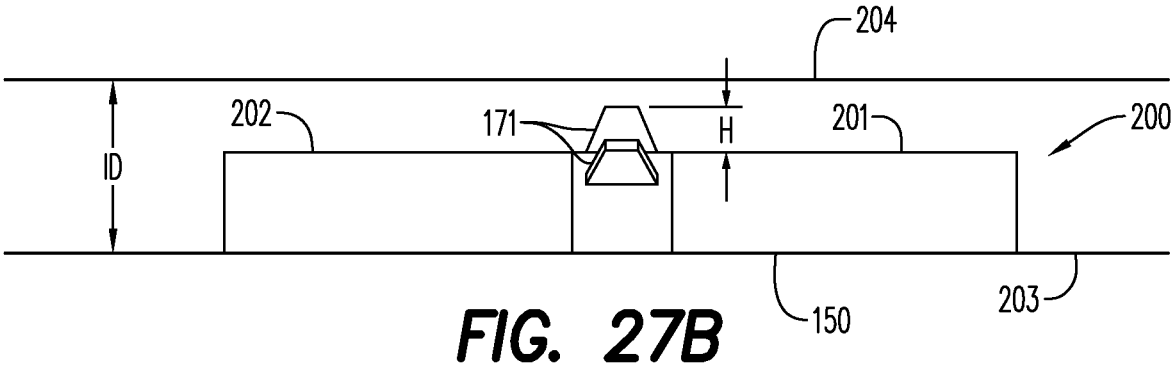
FIG. 27B shows a wellbore tool string positioned inside a wellbore casing according to an embodiment.

In an embodiment and with reference to FIGS. 27A and 27B, two or more fins 171 are secured to an outer surface of the adapter body 151 to space the wellbore tool string 200 apart from a surface of a wellbore casing and to assist in orienting the tool-string and thereby the direction of the perforations in a specific desired direction. The fins 171 orient the wellbore tool string 200 in the wellbore so that when the wellbore tool string 200 is laying horizontally in a wellbore casing 203, the wellbore tool string 200 is spaced apart from a horizontal surface 204 of the wellbore casing 203 by the fins 171 so that the tool string 200 and the shaped charges housed in the tool string 200 are oriented in a desired direction. The fins 171 adjust the axial positioning of the wellbore tool string 200 in the wellbore by moving the wellbore tool string 200 away from the horizontal surface 204 of the wellbore casing 203. According to an aspect, the fins 171 space apart the wellbore tool string 200 from the wellbore casing 203 such that an unwanted or unintentional rotation or rolling of the tool-string 200 downhole is prevented so that the perforations are always oriented or aligned in a desired specific direction within certain degrees of accuracy. The accuracy or degree of limitation which the fins can hold the tool string 200 in the desired location depends on the overall tool string 200 design, as well as the height H of the fins 171 compared to the inner-diameter ID of the wellbore casing 203.

In the exemplary embodiment, the two or more fins 171 are positioned on the outer surface of the TSA 150 on a top side of the TSA 150. The two or more fins 171 may be positioned generally in alignment with the firing path of the shaped charges housed in the housings 201, 202 of the wellbore tool string 200. In an embodiment, the firing path of the shaped charges may be aligned with a top side of the perforating gun housing and the TSA, such that the pitch of the firing path is 0 degrees. Alternatively, the firing path of the shaped charges may be aligned with a bottom side of the perforating gun housing, such that the pitch of the firing path is 180 degrees. In such an embodiment, the two or more fins 171 are positioned generally about 180 degrees from the firing path of the shaped charges, such that the two or more fins 171 maintain an orientation of the wellbore tool string 200 for firing the shaped charges in a downward direction. According to an aspect, fin screw holes 173 may be formed in the adapter body 151 extending from the outer surface of the adapter body 151 toward the center of the adapter body 151 for receiving a screw 172 that passes through the fin 171 for attachment of the fin 171 to the adapter body 151. In the exemplary embodiment, three fins are included in the TSA 150. However, any number of fins 171 in accordance with this disclosure may be used to provide the desired axial positioning of the wellbore tool string in the wellbore casing. In an embodiment, the fins 171 may be spaced apart from one another about the adapter body 151. For example, the fins 171 may be mounted at a distance of about 60 degrees from one another. In an embodiment, the TSA 150 may include a circumferential recess 174 formed around the exterior surface of the adapter body 151. According to an aspect, the circumferential recess 174 may receive a support structure, for example a lifting plate, make-up plate, or rig-up plate, for use in lifting up the tool string 200 for vertical assembly of the tool string components (e.g., gun housing 201, gun housing 202, TSA 150, and/or alignment sub 100).

The wellbore tool string 200, such as a perforating gun string, may include an orienting alignment sub assembly, which includes each of the alignment sub 100 and the TSA 150 as described above and shown in FIGS. 25-26. The first perforating gun housing 201 houses a shaped charge holder with an electrically contactable component, and includes a threaded end. The first sub body part 101 of the alignment sub 100 includes a first sub body part first end, a first sub body part insertable portion 104 axially adjacent to the first sub body part first end, and a first sub body part bore 105 extending from the first sub body part first end 102 in a x-direction through the first sub body part insertable portion 104. An electrical component 136 (e.g., an electrically contactable bulkhead assembly 137) is positioned in the first sub body part bore 105.

A second sub body part 118 is positioned around and rotatably engaged with the first sub body part insertable portion 104. The second sub body part 118 includes a second sub body part recess 124 extending in a x-direction from a second sub body part first end 119 toward a second sub body part second end 120, a second sub body part cavity 121 extending in a x-direction from the second sub body part second end 120 toward the second sub body part first end 119, and a second sub body part medial channel 123 extending from the second sub body part recess 124 to the second sub body part cavity 121, wherein the first sub body part insertable portion 104 is positioned in the second sub body part cavity 121 and the second sub body part medial channel 123.

A tandem sub assembly 150 is connected to the second sub body part 118, and includes an adapter body 151 having a first adapter body recess 154 extending in a x-direction from a first adapter body end 152, wherein the first adapter body recess 154 is defined by a first adapter body recess wall 155, a second adapter body recess 158 extending in a x-direction from a second adapter body end 156, wherein the second adapter body recess 158 is defined by a second adapter body recess wall 159, and an adapter bore 160 extending in a x-direction from the first adapter body recess wall 155 to the second adapter body recess wall 159. A contact rod 162 is positioned in the adapter bore 160 and is electrically connected to the electrical assembly 136. The tandem sub assembly 150 includes a plurality of fins 171 positioned externally on the adapter body 151.

A second alignment sub 100' as described above is coupled to the tandem sub assembly 150, and includes a second electrical assembly 136 that is electrically connected to the contact rod 162. A second perforating gun housing 202 housing a shaped charge holder with an electrically contactable component that is electrically connected to the second electrical assembly 136' has a threaded end that is coupled to the second alignment sub 100'.

According to an aspect, the first gun housing 201 includes surface scallops 203, and the second gun housing 202 includes surface scallops 204, wherein the first gun housing surface scallops 203 and the second gun housing surface scallops 204 align with a firing path of an internal shaped charge. Rotation of the first sub body part 101 in the second sub body part 118 aligns the first gun housing surface scallops 203 with the second gun housing surface scallops 204. When the first gun housing surface scallops 203 are aligned with the second gun housing surface scallops 204, the alignment sub 100 may be locked as described above with a lock screw to fix the angular position of the first gun housing 201 relative to the second gun housing 202.

The two or more fins 171 orient the rotational position of the perforating gun string 200 in a wellbore. According to an aspect, the two or more fins 171 are positioned on the adapter body 151 in a spaced apart configuration. In the exemplary embodiment, each of the two or more fins 171 are radially offset from the surface scallops 203, 204 when the gun housing 201, 202 are aligned, such that the fins 171 are offset from the shaped charge firing path by about 30 degrees.

Embodiments of the disclosure are further associated with a method of aligning a pitch of shaped charges in a wellbore tool string. A first wellbore tool 201 is coupled to a first end 119 of an alignment sub 100 comprising a first sub body part 101 rotatably coupled to a second sub body part 118. According to an aspect, the first sub body part 101 is rotatably coupled to the second sub body part 118 by inserting an insertable portion 104 of the first sub body part 101 into a cavity 121 of the second sub body part 118. A second wellbore tool 202 is coupled to a second end 102 of the alignment sub 100. According to an aspect, the first wellbore tool 201 is coupled to the alignment sub first end 119 by threadedly coupling, and the second wellbore tool 202 is coupled to the alignment sub second end 102 by threadedly coupling.

The first wellbore tool 201 is rotated relative to the second wellbore tool 202 to align a wellbore housing scallop 203 on the first wellbore tool 201 with a wellbore housing scallop 204 on the second wellbore tool 202. The alignment sub 100 is locked to retain the alignment of the first wellbore housing scallop 203 relative to the second wellbore housing scallop 204. According to an aspect, locking the alignment sub 100 may include at least one of inserting a sub locking screw 129 through the second sub body part 118 into the second sub body part cavity 121 to contact the first sub body part insertable portion 104, and inserting a second sub body part retainer ring 130 into the recess 124 of the second sub body part to secure the first sub body part insertable portion 104 to the second sub body part recess 124 and to retain the first sub body part first end 102 within the second sub body part recess 124.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. An alignment sub, comprising:

a first sub body having a first sub body first end and a first sub body second end opposite the first sub body first end, the first sub body comprising:

a first sub body first inner surface defining a first sub body first bore extending from the first sub body second end towards the first sub body first end;

a first sub body second inner surface defining a first sub body second bore extending from the first sub body first bore toward the first sub body first end, the first sub body second bore having a smaller diameter than the first sub body first bore; and a first sub body recess wall extending radially between the first sub body first inner surface and the first sub body second inner surface;

a bulkhead body provided in the first sub body second bore;

bulkhead retainer dimensionally configured to secure the bulkhead body within the first sub body second bore, the bulkhead retainer being positioned within the first sub body first bore adjacent the first sub body recess wall; and a second sub body having a second sub body first end and a second sub body second end opposite the second sub body first end, the second sub body comprising:

a second sub body first inner surface defining a second sub body first bore; and a sub locking screw switchable between an unlocked state and a locked state such that, when the sub locking screw is in the locked state, a rotational position of the first sub body is fixed relative to a rotational position of the second sub body;

wherein the first sub body is rotatably coupled to the second sub body and a portion of the first sub body is positioned within the second sub body first bore, the first sub body further comprises a channel provided on the outer surface of the first sub body;

the second sub body further comprises a socket extending through the second sub body at a position radially overlapping with the channel;

the sub locking screw is secured in the socket;

the outer surface of the first sub body includes a channel lip axially adjacent to the channel; and an outer diameter of the first sub body at the channel lip is greater than an outer diameter of the first sub body at the channel.

2. The alignment sub of claim 1, wherein:

the second sub body first bore extends from the second sub body second end toward the second body first end, and the second sub body further comprises:

a second sub body second inner surface defining a second sub body second bore axially displaced from the second sub body first bore toward the second sub body first end, wherein the first sub body first end is positioned in the second sub body second bore.

3. The alignment sub of claim 1, wherein the first sub body further comprises:

a first sub body third inner surface defining a first sub body third bore extending from the first sub body second bore to the first sub body first end, wherein the first sub body third bore is dimensionally configured to receive a first bulkhead pin of the bulkhead body.

4. The alignment sub of claim 1, further comprising:

a first bulkhead pin extending from a first end of the bulkhead body, and a second bulkhead pin extending from a second end of the bulkhead body, wherein:

the bulkhead body includes a bulkhead o-ring compressively engaged with the first sub body second inner surface radially adjacent to the first sub body second bore;

the bulkhead retainer further comprises a bulkhead retainer aperture and an outer surface in threaded engagement with the first sub body first inner surface; and the second bulkhead pin extends through the bulkhead retainer aperture.

5. The alignment sub of claim 1, wherein a longitudinal axis of the bulkhead body is a central axis of rotation of the second sub body around the first sub body.

6. A perforating gun assembly comprising:

a first perforating gun housing;

a first shaped charge provided within the first perforating gun housing;

an alignment sub coupled to the first perforating gun housing, the alignment sub comprising:

a first sub body; and a second sub body rotatably coupled to the first sub body via a non-threaded interface between an outer surface of the first sub body and an inner surface of the second sub body; and a sub locking screw switchable between an unlocked state and a locked state such that, when the sub locking screw is in the locked state, a rotational position of the first sub body is fixed relative to a rotational position of the second sub body;

wherein the first sub body further comprises a channel provided on the outer surface of the first sub body;

the second sub body further comprises a socket extending through the second sub body at a position radially overlapping with the channel;

the sub locking screw is secured in the socket;

the outer surface of the first sub body includes a channel lip axially adjacent to the channel; and an outer diameter of the first sub body at the channel lip is greater than an outer diameter of the first sub body at the channel.

7. The perforating gun assembly of claim 6, wherein:

in the unlocked state, the sub locking screw is radially spaced apart from the outer surface of the first sub body radially adjacent the channel; and in the locked state, the sub locking screw is in frictional contact with the outer surface of the first sub body radially adjacent the channel.

8. The perforating gun assembly of claim 6, wherein the socket is one of a plurality of sockets spaced apart about the second sub body.

9. The perforating gun assembly of claim 6, wherein the second sub body comprises:

a second sub body first end; and a second sub body second end spaced apart from the second sub body first end, the inner surface of the second sub body defining a second sub body first bore extending from the second sub body second end toward the second sub body first end, wherein the first sub body has a first sub body first end positioned in the second sub body first bore.

10. The perforating gun assembly of claim 9, further comprising:

a second sub body retainer ring provided in the second sub body first bore, wherein the second sub body retainer ring is engaged with each of the inner surface of the second sub body and the first sub body to prevent axial movement of the first sub body relative to the second sub body.

11. The perforating gun assembly of claim 10, wherein:

the first sub body first end further comprises a threaded surface portion; and the second sub body retainer ring is threadedly engaged with the first sub body threaded surface portion.

12. The perforating gun assembly of claim 6, wherein the first sub body comprises:

a first sub body first inner surface defining a first sub body first bore extending between a first sub body first end and a first sub body second end, wherein a longitudinal axis of the first sub body bore is a central axis of rotation of the alignment sub.

13. The perforating gun assembly of claim 6, wherein:

the first sub body includes a first sub body threaded exterior portion that is coupled to the first perforating gun housing.

14. The perforating gun assembly of claim 13, further comprising:

a second perforating gun housing; and a second shaped charge provided within the second perforating gun housing;

wherein the second sub body is coupled to the second perforating gun housing.

15. The perforating gun assembly of claim 14, wherein the second sub body includes a second sub body threaded exterior portion coupled to the second perforating gun housing.

16. The perforating gun assembly of claim 6, further comprising:

a second sub body retainer ring provided in the second sub body, wherein the second sub body comprises:

a second sub body first end; and a second sub body second end spaced apart from the second sub body first end, the inner surface of the second sub body defining a second sub body first bore extending from the second sub body second end toward the second sub body first end, the first sub body first end is positioned in the second sub body, and the second sub body retainer ring is engaged with each of the inner surface of the second sub body and with the first sub body to prevent axial movement of the first sub body relative to the second sub body.

17. The perforating gun assembly of claim 6, wherein:

the first sub body comprises:

a first sub body first inner surface defining a first sub body first bore extending from a first sub body second end towards a first sub body first end;

a first sub body second inner surface defining a first sub body second bore extending from the first sub body first bore toward the first sub body first end; and a first sub body recess wall extending radially between the first sub body first inner surface and the first sub body second inner surface; and the second sub body comprises:

a second sub body first inner surface defining a second sub body first bore extending from a second sub body second end toward a second sub body first end.

18. The perforating gun assembly of claim 17, further comprising:

a bulkhead body provided in the first sub body second bore, wherein the bulkhead body includes a bulkhead o-ring compressively engaged with the first sub body second inner surface radially adjacent to the first sub body second bore; and a first bulkhead pin and a second bulkhead pin extending from either end of the bulkhead body.

19. The perforating gun assembly of claim 18, further comprising: a bulkhead retainer positioned in the first sub body first bore adjacent the first sub body recess wall, wherein the bulkhead retainer is dimensionally configured to secure the bulkhead body within the first sub body second bore, the bulkhead retainer having an outer surface in threaded engagement with the first sub body first inner surface and defining a central aperture through which the first bulkhead pin extends.

* * * * *